US010067448B2

(12) United States Patent
Nishida et al.

(10) Patent No.: US 10,067,448 B2
(45) Date of Patent: Sep. 4, 2018

(54) IMAGE FORMING APPARATUS HAVING A CONTROLLER THAT SETS A TARGET TEMPERATURE BASED ON DENSITY INFORMATION

(71) Applicant: CANON KABUSHIKI KAISHA, Tokyo (JP)

(72) Inventors: Satoshi Nishida, Numazu (JP); Isamu Takeda, Machida (JP); Atsushi Nakamoto, Tokyo (JP); Akimichi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/701,831

(22) Filed: Sep. 12, 2017

(65) Prior Publication Data

US 2018/0074445 A1 Mar. 15, 2018

(30) Foreign Application Priority Data

Sep. 13, 2016 (JP) ..... 2016-178418

(51) Int. Cl.
*G03G 15/20* (2006.01)
*G03G 15/00* (2006.01)

(52) U.S. Cl.
CPC ..... *G03G 15/2046* (2013.01); *G03G 15/2028* (2013.01); *G03G 15/556* (2013.01)

(58) Field of Classification Search
CPC ..... G03G 15/2046
USPC ..... 399/69
See application file for complete search history.

(56) References Cited

U.S. PATENT DOCUMENTS

| | | | | |
|---|---|---|---|---|
| 9,310,727 | B2 | 4/2016 | Masumoto et al. | |
| 9,377,727 | B2 * | 6/2016 | Yoshioka | G03G 15/2039 |
| 2012/0213540 | A1 | 8/2012 | Igarashi | |
| 2014/0219672 | A1 * | 8/2014 | Samei | G03G 15/2039 399/69 |

FOREIGN PATENT DOCUMENTS

| | | | |
|---|---|---|---|
| JP | 2003-186342 | A | 7/2003 |
| JP | 2004-061926 | A | 2/2004 |
| JP | 2005-321672 | A | 11/2005 |
| JP | 2006-011120 | A | 1/2006 |
| JP | 2006-154413 | A | 6/2006 |
| JP | 2009-092688 | A | 4/2009 |
| JP | 2012-173462 | A | 9/2012 |
| JP | 2014-006400 | A | 1/2014 |
| JP | 2015-114481 | A | 6/2015 |

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes an image forming portion to form a toner image on a recording material on the basis of image information, a fixing portion to fix the toner image on the recording material, fixing portion including a heating member and an opposing member to form a nip, a temperature detecting member to detect a temperature of the heating member, a controller to control electrical power supplied to the heating member so that the temperature detected by the temperature detecting member is a target temperature, and an acquiring portion to acquire density information of the toner image from the image information. The controller sets the target temperature depending on the density information.

18 Claims, 18 Drawing Sheets

| PRE-PRINT TEMP. | Zl | Zc | Zr |
|---|---|---|---|
| -119°C | Mid | Mid | Mid |
| 120°C-149°C | Mid | High | Mid |
| 150°C- | Low | High | Low |

FIG.13

IMAGE FORMING APPARATUS HAVING A CONTROLLER THAT SETS A TARGET TEMPERATURE BASED ON DENSITY INFORMATION

This application claims the benefit of Japanese Patent Application No. 2016-178418 filed on Sep. 13, 2016, which is hereby incorporated by reference herein in its entirety.

FIELD OF THE INVENTION AND RELATED ART

The present invention relates to an image forming apparatus and is suitable as an image forming apparatus, such as a copying machine or a printer, employing an electrophotographic type.

Conventionally, in the image forming apparatus using an electrophotographic process, a toner image formed on a photosensitive member is transferred onto a recording material and, thereafter, passes through a fixing device as an image heating apparatus, so that the toner image is fixed on the recording material.

As regards the fixing device, an operation heat-fixing device in which an unfixed toner image is fixed as a fixed image through contact-heating by a fixing member heated to a predetermined fixing temperature by a heating member.

Further, conventionally, a fixing temperature of the fixing member is controlled on the basis of image information (toner density, or the like) of image data, so that improvement in fixing property and reduction of electric power consumption have been realized.

As a means for optimizing the fixing property depending on an image, a constitution in which density information on the recording material is detected and a fixing control temperature is changed has been known (Japanese Laid-Open Patent Application (JP-A) 2006-154413, and JP-A 2009-92688) has been known. Further, a constitution in which an image distribution in a one-page image is taken into consideration and a plurality of heating members is provided and arranged, and in which image data are divided into a plurality of areas correspondingly to widths of the respective heating members and the heating members are heated depending on image positions of the areas, respectively, has been known (JP-A 2012-173462, and JP-A 2014-006400).

However, when the plurality of heating members are provided in the fixing device, the number of electrical power supplying circuits and control circuits of the heating members are increased, so that the fixing device is upsized and electrical power control is complicated.

Further, a surface temperature distribution is influenced by not only a control temperature of the heating member, but also, escape of heat, such as heat distribution from a supporting portion and a surface of the fixing member, and the influence thereof changes also depending on a warming-up (warming air) state of the fixing member and, therefore, is not uniform.

SUMMARY OF THE INVENTION

According to one aspect, the present invention provides an image forming apparatus comprising an image forming portion configured to form a toner image on a recording material on the basis of image information, a fixing portion configured to fix the toner image on the recording material, wherein the fixing portion includes a heating member and an opposing member configured to form a nip in cooperation with the heating member in contact with the heating member, a temperature detecting member configured to detect a temperature of the heating member, a controller configured to control electrical power supplied to the heating member so that the temperature detected by the temperature detecting member is a target temperature, and an acquiring portion configured to acquire density information of the toner image from the image information, wherein the acquiring portion acquires the density information in each of a central region and an end region of an image formable region of the recording material with respect to a widthwise direction perpendicular to a feeding direction of the recording material, wherein the recording material, on which the toner image is formed, is heated while being fed in the nip, and the toner image is fixed on the recording material, and wherein, when a detection temperature by the temperature detecting member is higher than a predetermined temperature at a timing immediately after an image formation start signal is received, the controller sets the target temperature depending on the density information in the end region, irrespective of the density information in the central region.

Further features of the present invention will become apparent from the following description of exemplary embodiments with reference to the attached drawings.

DESCRIPTION OF THE DRAWINGS

FIG. 13 is a table showing an example in which a reference density rank in each of image information acquiring regions is set on the basis of a pre-print temperature in the Second Embodiment.

DESCRIPTION OF EMBODIMENTS

Embodiments of the present invention will be described with reference to the drawings.

First Embodiment (Image Forming Apparatus)

Figure 1:
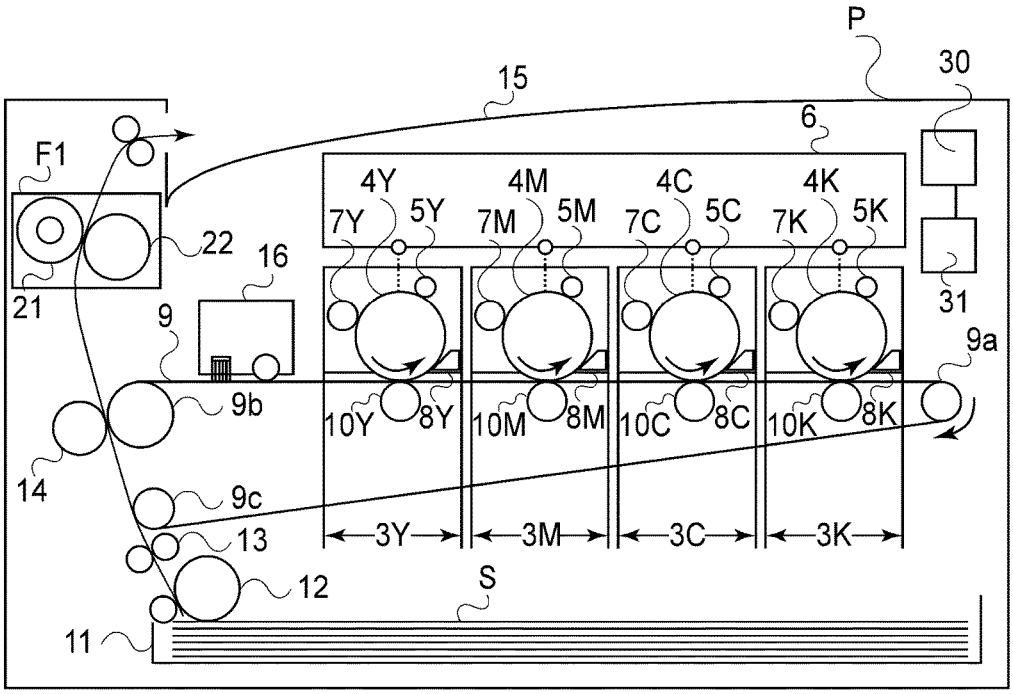
FIG. 1 is a schematic view illustrating an image forming apparatus according to a First Embodiment of the present invention.

An image forming apparatus P according to this embodiment of the present invention will be described. FIG. 1 is a schematic view showing the image forming apparatus P used in this embodiment, and the image forming apparatus P includes four image forming stations 3Y, 3M, 3C, and 3K arranged in a substantially rectilinear line shape. Of the four image forming stations 3Y, 3M, 3C, and 3K, 3Y is the image forming station for forming an image of yellow (Y), 3M is the image forming station for forming an image of magenta (M), 3C is the image forming station for forming an image of cyan (C), and 3K is the image forming station for forming an image of black (K).

The image forming stations 3Y, 3M, 3C, and 3K include drum-shaped electrophotographic photosensitive members (photosensitive drums) 4Y, 4M, 4C, and 4K as image bearing members and charging rollers 5Y, 5M, 5C, and 5K as charging means. Further, the image forming stations 3Y, 3M, 3C, and 3K include an exposure device 6, developing devices 7Y, 7M, 7C, and 7K as developing means and cleaning devices 8Y, 8M, 8C, and 8K as cleaning means.

As regards a video controller 30, when the video controller 30 receives image information from an external device (not shown) such as a host computer, the video controller 31 sends a print signal to a control means (control portion, heating controller), so that an image forming operation starts. For image formation, in the image forming station 3Y, the photosensitive drum 4Y is rotated in an arrow direction.

First, an outer peripheral surface of the photosensitive drum 4Y is electrically charged uniformly by the charging roller 5Y, and the charged surface of the photosensitive drum 4Y is exposed to light by being irradiated with laser light depending on image data by the exposure device 6, so that an electrostatic latent image is formed. The latent image is visualized with Y toner by the developing device 7Y, so that a Y toner image is formed. As a result, the Y toner image is formed on the surface of the photosensitive drum 4Y. Also, in each of the image forming stations 3M, 3C, and 3K, a similar image forming process is carried out. As a result, an M toner image, a C toner image and a K toner image are formed on the surfaces of the photosensitive drums 4M, 4C, and 4K, respectively.

An endless intermediary transfer belt 9 provided along an arrangement direction of the image forming stations 3Y, 3M, 3C, and 3K is stretched by a driving roller 9*a*, a follower roller 9*b* and a follower roller 9*c*. The driving roller 9*a* rotates in an arrow direction in FIG. 1. As a result, the intermediary transfer belt 9 is rotated and moved at a speed of 100 mm/sec along the image forming stations 3Y, 3M, 3C, and 3K.

Onto the outer peripheral surface of the intermediary transfer belt 9, the respective color toner images are successively transferred superposed by primary transfer means 10Y, 10M, 10C, and 10K provided opposed to the photosensitive drums 4Y, 4M, 4C, and 4K, respectively, while sandwiching the intermediary transfer belt 9 therebetween. As a result, a four-color-based full-color toner image is formed on the surface of the intermediary transfer belt 9.

Transfer residual toners remaining on the surfaces of the photosensitive drums 4Y, 4M, 4C, and 4K after primary transfer are removed by unshown cleaning blades provided in the cleaning devices 8Y, 8M, 8C, and 8K, respectively. As a result, the photosensitive drums 4Y, 4M, 4C, and 4K prepare for subsequent image formation.

On the other hand, recording materials S stacked and accommodated in a (sheet) feeding cassette 11 provided at a lower portion of an apparatus main assembly P of the image forming apparatus are separated and fed one by one from the feeding cassette 11 by the feeding roller 12, and the fed recording material S is further fed to a registration roller pair 13. The registration roller pair 13 sends the fed recording material S to a transfer nip between the intermediary transfer belt 9 and a secondary transfer roller 14.

The secondary transfer roller 14 is provided so as to oppose the follower roller 9B while sandwiching the intermediary transfer belt 9 between itself and the follower roller 9*b*. To the secondary transfer roller 14, a bias is applied from an unshown high-voltage source when the recording material S passes through the transfer nip. As a result, the full-color toner image is secondary-transferred from the surface of the intermediary transfer belt 9 onto the recording material S passing through the transfer nip. The above-described members such as the photosensitive drums 4, the intermediary transfer belt 9, and the primary transfer rollers 14 constitute the image forming portion.

The recording material S carrying the toner image thereon is fed to a fixing device F1. The recording material S is heated and pressed by passing through the fixing device F1, so that the toner image is heat-fixed on the recording material S. Then, the recording material S is discharged from the fixing device F1 onto a discharge tray 15 provided at an outer portion of the image forming apparatus (printer) P.

Transfer residual toner remaining on the surface of the intermediary transfer belt 9 after secondary transfer is removed by an intermediary transfer belt cleaning device 16. As a result, the intermediary transfer belt 9 prepares for subsequent image formation.

(Fixing Device (Fixing Portion))

The fixing device (fixing portion) F1 for fixing the toner image will be described. In the following description, as regards the fixing device and members constituting the fixing device, a longitudinal direction is a direction perpendicular to a recording material feeding direction in a plane of the recording material, and a widthwise direction is a direction parallel to the recording material feeding direction in the plane of the recording material. A width is a dimension with respect to the widthwise direction. As regards the recording material, a longitudinal width is a dimension with respect to the direction perpendicular to the recording material feeding direction in the plane of the recording material.

Figure 2:
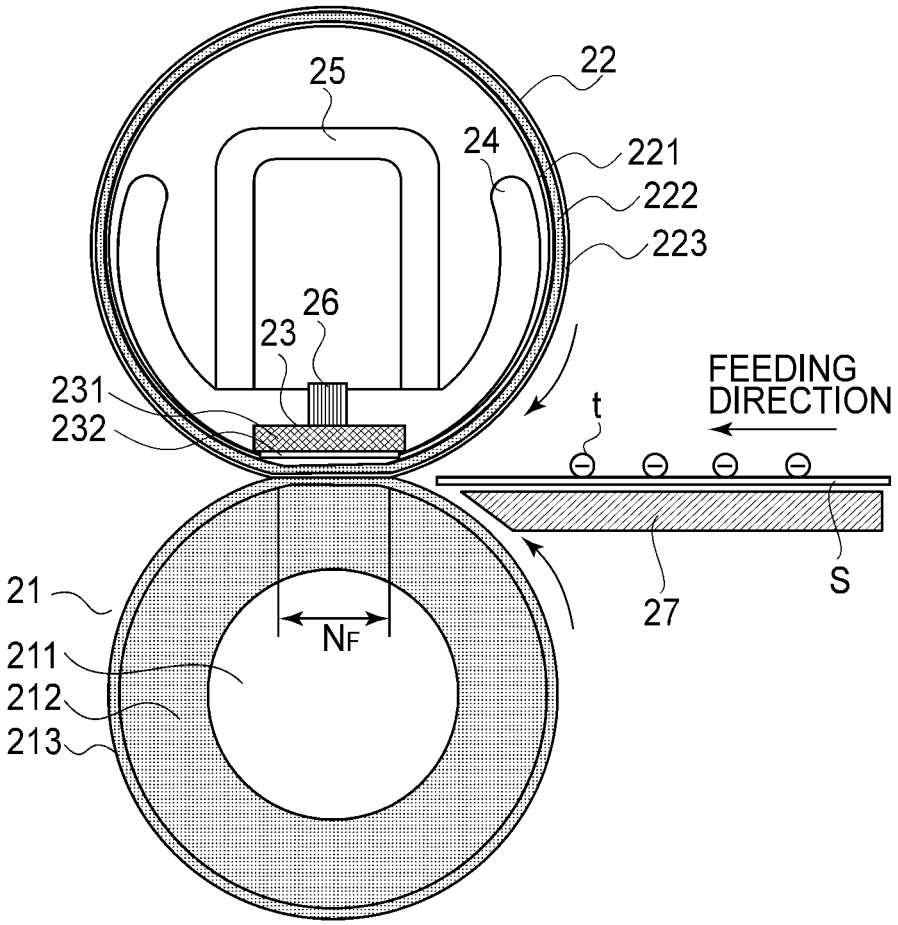
FIG. 2 is a schematic view illustrating a cross-sectional structure of a fixing portion in First Embodiment.

FIG. 2 is a schematic cross-sectional view of the fixing device F1. In the fixing device F1, a pressing roller 21 as an opposing member (pressing member), to a fixing film 22, for forming a nip, while nipping and feeding the recording material in a pressed state in combination with the fixing film 22, is rotationally driven, and rotates the fixing film 22 by a feeding force of the pressing roller 21. That is, the fixing device F1 is a device of a so-called tensionless-type using a fixing feeding type and a pressing roller driving type.

The fixing device F1 in this embodiment includes the pressing roller (pressing member) 21, the fixing film (rotatable fixing member) 22, a heater 23, a heater holder (holding member) 24, and a rigid stay 25. A unit including the fixing film 22, the heater 23, the heater holder 24, and the rigid stay 25 is a heating member. Each of the pressing roller 21, the fixing film 22, the heater 23, the heater holder 24, and the rigid stay 25 is a thin and long member extending in the longitudinal direction.

The heater 23 includes a thin and long ceramic substrate 231, which has a heat-resistant property, an insulating property and a good heat-conductive property and which extends in the longitudinal direction. Further, a heat generating resistor (not shown) is formed and provided along a longitudinal direction of the substrate 231 at a widthwise central portion in a front side (pressing roller 21 side) of the substrate 231. Inside of the substrate 231 at each of longitudinal end portions of the substrate 231, an electrical power supplying electrode (not shown) for supplying electrical power to the heat generating resistor is provided. Further, a heat-resistant overcoating layer 232 is provided so as to coat the heat generating resistor in the surface side of the substrate 231.

Figure 3:
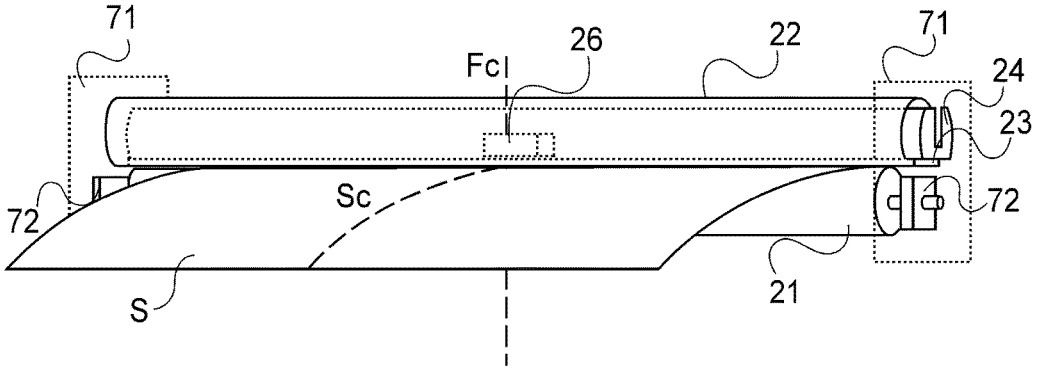
FIG. 3 is a schematic view illustrating a structure of the fixing portion with respect to a longitudinal direction in First Embodiment.

FIG. 3 is a schematic longitudinal view of the fixing device F1. The heater holder 24 is formed in a substantially semicircular trough shape in cross section with a liquid polymer having a heat-resistant property and rigidity. The heater holder 24 is provided with a groove portion provided along a longitudinal direction of a lower surface thereof at a widthwise central portion, and the groove portion fixedly holds the substrate 231 and causes the overcoating layer 232 to be exposed from the groove portion.

The fixing film 22 is formed in a cylindrical shape with a flexible heat-resistant resin material. An outer peripheral length of the fixing film 22 is 57 mm. The fixing film 22 includes a 50 μm-thick polyimide layer as a cylindrical base layer 221 and a 200 μm-thick elastic layer 222 formed with silicone rubber on an outer peripheral surface of the base layer 221. On an outer peripheral surface of the elastic layer 222, a 15 μm-thick parting layer 223 of a fluorine-containing resin material is formed.

An inner peripheral length of the fixing film 22 is made greater than an outer peripheral length of the heater holder 24 holding the heater 23 by 3 mm. Further, the fixing film 22 is loosely fitted around the heater holder 24 holding the heater 23 with a peripheral length margin. That is, the fixing film 22 contains the heater 23.

The rigid stay 25 is constituted by an inverted U-shaped rigid member in cross section. The rigid stay 25 is disposed on an upper surface of the heater holder 24 with respect to a widthwise central portion of the heater holder 24.

In FIG. 2, the feeding roller 21 includes a round shaft-shaped core metal 211, an elastic layer 212 formed of a silicone rubber integrally with the core metal 211 on an outer peripheral surface of the core metal 211, and a parting layer 213 formed of an electroconductive fluorine-containing resin material around the elastic layer 212. An outer peripheral length of the pressing roller 21 is 63 mm. The elastic layer 212 may also be formed of a heat-resistant rubber such as a fluorine-containing rubber or a foamed material of a silicone rubber. The parting layer 213 may also be an insulating fluorine-containing resin material.

The pressing roller 21 is disposed below and in parallel with the fixing film 22, and longitudinal end portions of the core metal 211 are rotatably held through bearing members. Further, the core metal 211 of the pressing roller 21 and the rigid stay 25 are pressed at longitudinal end portions by unshown pressing springs so that the outer peripheral surfaces of the pressing roller 21 and the fixing film 22 are in contact with each other. By the pressing force, the surface of the pressing roller 21 and the surface of the fixing film 22 are contacted to each other, so that a nip $N_F$, having a predetermined width, for nipping and feeding the recording material S is formed between the pressing roller 21 surface and the fixing film 22 surface. A total of the pressing force is 20 kgf.

An unshown rotation controller (drive control means) rotates the pressing roller 21 at a peripheral speed (process speed) of 100 mm/sec in an arrow direction as shown in FIG. 2 depending on a print instruction. At that time, by a frictional force between the surfaces of the pressing roller 21 and the fixing film 22 in the nip $N_F$, a rotational force acts on the fixing film 22. For that reason, the fixing film 22 is rotated by the rotational force in the arrow direction along an outer periphery of the heater holder 24 while intimately sliding on the heater 23 at an upper peripheral surface thereof.

At that time, the rotation of the fixing film 22 is guided by the outer peripheral surface of the heater holder 24 formed along an inner peripheral shape of the fixing film 22. As a result, the rotation of the fixing film 22 is stabilized, so that the fixing film 22 is rotated while drawing the same rotation locus. Further, the controller 31, functioning as an electrical power supply controller (temperature controller, heating controller) supplies electrical power to the unshown heat generating resistor of the heater 23. By the supply of the electrical power, the heater 23 increases in temperature and heats the fixing film 22.

The temperature of the heater 23 is detected by a temperature detecting element 26, as a temperature acquiring means such as a thermistor, provided in the back surface side of the substrate 231 of the heater 23. On the basis of an output signal of the temperature detecting element 26, the electrical power supply controller 31 controls the supply of electrical power to the unshown heat generating resistor so that the heater 23 can maintain a predetermined control (target) temperature (heating temperature to be heat-controlled) T. As a result, the $N_F$ is maintained at the predetermined control temperature (target temperature) T is controlled at 120° C. to 230° C.

The recording material S is introduced into the fixing device F1 so that a central portion Sc (FIG. 3) of the recording material S passes through a recording material feeding center Fc of the fixing device F1. The image forming apparatus in this embodiment is compatible with recording materials having sizes ranging from LTR size to LGL size and is compatible with a sheet (paper) width up to 216 mm with respect to the longitudinal direction of the fixing device F1. Further, an image having an image width up to 208 mm with respect to the longitudinal direction of the fixing device F1, excluding a margin of 5 mm at each of end portions of the LTR-sized recording material and the LGL-sized recording material, is capable of being formed and fixed.

The heat generating resistor of the heater 23 is formed in a bilaterally symmetrical manner with respect to the recording material feeding center Sc in a length of 210 mm longer than a maximum fixable image width by 2 mm so that a maximum image is fixable even when the maximum image is shifted. Further, the temperature detecting element 26 of the heater 23 is disposed on the line of the recording material feeding center Fc with respect to the longitudinal direction of the fixing device F1.

The length of the pressing roller 21 with respect to the longitudinal direction is 220 mm longer than a recording material maximum width of 216 mm so that the image can be heat-fixed on a maximum-sized recording material S while feeding the recording material S, and the length of the fixing film 22 with respect to the longitudinal direction is 222 mm.

The heater holder 24 holding the heater 23 is held by a fixing device side plate 71 (FIG. 3) at each of the longitudinal end portions. The pressing roller 21 is held at each of the longitudinal end portions by the fixing device side plate 71 through a bearing member of the core metal 211. A distance between the fixing device side plates 71 is 226 mm.

(Image Processing Means (Image Processing Portion))

Figure 4:
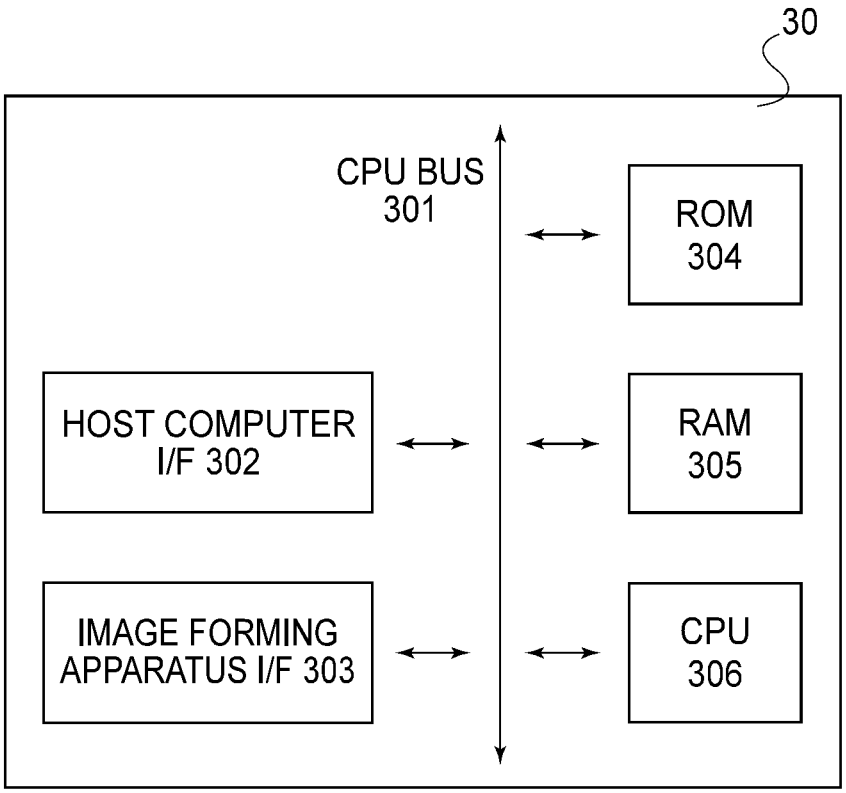
FIG. 4 is a schematic view illustrating a video controller in First Embodiment.

Next, the video controller 30 as an image processing means (image processing portion) will be described with reference to FIG. 4. The video controller 30 includes devices, such as a host interface portion 302, an image forming apparatus interface portion 303, a ROM 304, a RAM 305, and a CPU 306, which are connected with each other through a CPU bus 301. The CPU bus 301 includes an address bus, a data bus, and a control bus.

The host interface portion 302 has a function of establishing bidirectional communication connection with a data sending device such as a host computer through a network. The image forming apparatus interface portion 303 has a function of establishing bidirectional communication connection with the image forming apparatus P.

The ROM 304 stores a control program code for executing image data processing described later and other processing. The RAM 305 is a memory for storing image density information and bit map data as a result of rendering of image data received by the image forming apparatus interface portion 303 and for storing a temporary buffer area and various processing status. On the basis of the control program code stored in the ROM 304, the CPU 306 as a controller controls the respective devices connected with the CPU bus 301.

(Image Data Processing and Detection of Image Density Information)

Figure 5:
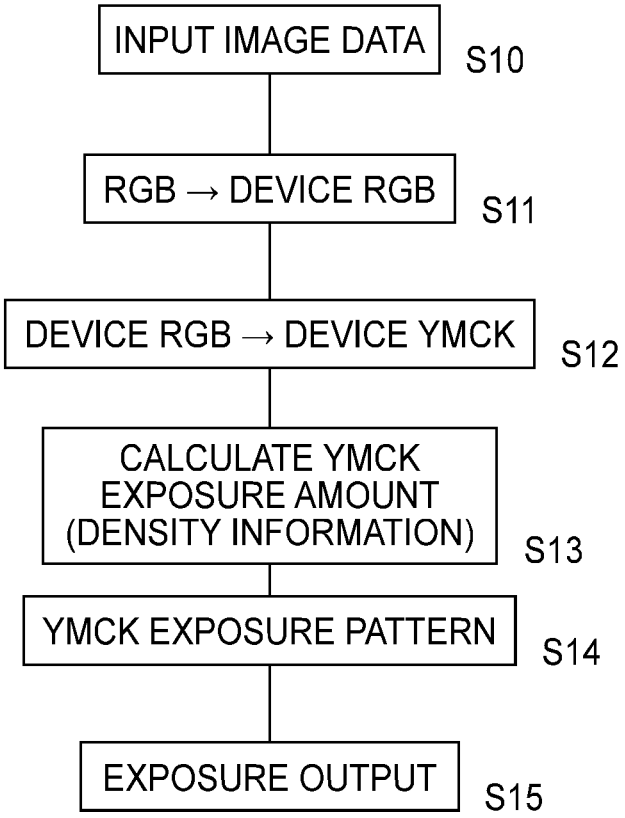
FIG. 5 is a flowchart illustrating an image data processing flow in First Embodiment.

First, image data processing will be described. FIG. 5 is a flowchart showing an image data processing flow. From the host computer, together with image at as image information, commands such as a sheet (paper) size and an operation mode are sent (process S10). In a case when the image data relates to a color image, the image data is in the form of color information by RGB (red, green, blue) data, and respective pieces of the color information are allocated and converted to reproducible device RGB data in the image forming apparatus (process S11). Then, the pieces of the color information of the image data are converted from the device RGB data to device YMCK (yellow, magenta, cyan, black) data (process S12).

The YMCK data is defined as data representing a ratio of a toner amount for associated data to an amount of the toner obtained on a toner image receiving member (material) in a case when all of lasers of the respective color image forming stations are turned on, and has a width (range) from 0% to 100%. A data value of 0% refers to a case when all of the lasers are turned off and thus the toner amount is zero. In this embodiment, an exposure amount for each of the respective colors of YMCK is calculated using a gradation table showing a relationship between the exposure amount for the associated color and an amount of an actually used toner with respect to an associated one of the YMCK data.

The video controller 30, as the image processing means (image processing portion) for generating an image signal for image formation from the received image data functions as a density acquiring means for acquiring density information of the toner image in a divided region described later, so that the image density is calculated from the YMCK data (process S13). For example, in a case when image data at a certain pixel is Y=50%, M=70%, C=20% and K=0%, the image density is 140 & (=50+70+20+0). Thereafter, with respect to each of the pixels, the exposure amount for the associated color is converted to an actually used exposure pattern (process S14), so that an exposure output is carried out (process S15).

Figure 6:
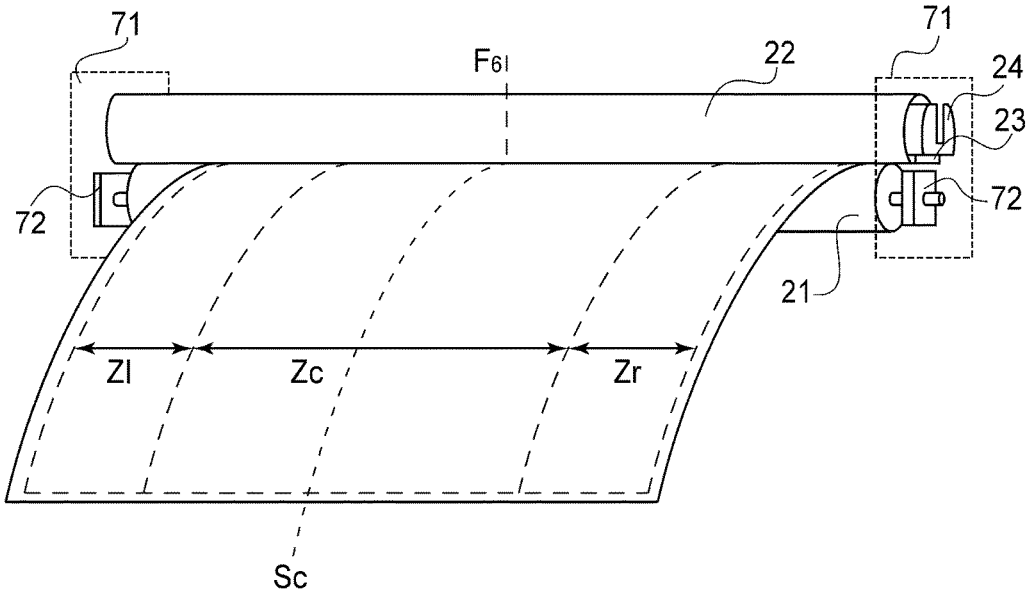
FIG. 6 is a schematic view illustrating an example of divided image density information acquiring regions.

In this embodiment, as shown in FIG. 6, an image formable region of the recording material is divided into a plurality of image information acquiring regions, and the image density is calculated from the image data for each of the divided regions, so that density information is acquired. With respect to the widthwise direction perpendicular to the recording material feeding direction, the image formable region is divided into three regions consisting of a first region Zc, which is a central region, a second region Zl, which is one end (portion) region, and a third region Zr, which is the other end (portion) region (opposite from the second region Zl while sandwiching the first region Zc between the second and third regions Zl and Zr).

The first region Zc is the central region having a width of 150 mm including, as a center, a position corresponding to the recording material feeding center Sc, and each of the second region Al and the third region Zr is the end region ranging from an associated edge (end) of the first region Zc to an associated edge (end) of a maximum fixable image width. When the widths of the first region Zc, the second region Zl, and the third region Zr are added up, the maximum fixable image width of 208 mm is acquired. Positions and widths of the respective image information acquiring regions are certain values irrespective of a size of the recording material used in the image forming apparatus and a size of the image formed by the image forming apparatus.

(Density Information and Toner Amount on Recording Material S)

First, a relationship between the density information and the toner amount on the recording material S will be described. The density information is pixel density information providing a maximum exposure amount in the associated one of the image information acquiring regions. In this embodiment, a minimum value of the density information is 0%, and a maximum value of the density information is 200%. The density information is correlated with an actual amount per unit area of the toner on the recording material S, and the amount per unit area of the toner on the recording material S when the density information is 100% is 0.45-0.50 mg/cm$^2$. Further, the amount per unit area of the toner on the recording material S when the density information is 200% is 0.90-1.00 mg/cm$^2$.

There are principally two reasons why the amount of the toner on the recording material S has a certain width (range). A first reason is that during the primary transfer, not all of the toners can be transferred from the photosensitive drums onto the intermediary transfer belt 9. A second reason is that during the secondary transfer, not all of the toners can be transferred from the intermediary transfer belt 9 onto the recording material S.

(Toner Amount on Recording Material and Suitable Target Temperature)

Next, a relationship between the toner amount on the recording material S and the target temperature (control temperature) of the heater 23 of the fixing device F1 will be described. It is preferable that the target temperature is changed to a suitable value depending on the toner amount on the recording material S. The suitable target temperature can be determined by checking a degree of fixing of the toner while changing the toner amount on the recording material S and the target temperature. In a case when only an excessively small heat quantity can be supplied to the toner of a certain amount, improper fixing generates, so that loss of the toner image or the like, generates. A suitable target temperature is a minimum temperature at which the improper fixing does not generate, and is a setting such that electrical power consumption is lowest. The suitable target temperature varies depending on the constitution and the process speed of the image forming apparatus.

(Experiment 1)

As regards the toner amount on the recording material S and the suitable target temperature, an experiment was conducted by the image forming apparatus in this embodiment, and the suitable target temperature was checked while changing the image density of the unfixed toner image t on the recording material S. The process speed of the image forming apparatus used in the experiment is 100 mm/s, and an interval (sheet interval) between a recording material S and a subsequent recording material S is 30 mm. The fixing device F1 is the fixing device used in this embodiment. In the experiment, a general-purpose LBP printing paper, i.e., a LTR-sized paper (width=216 mm, length=279 mm, basis weight=80 g/$m^2$) was used.

The unfixed toner image t was formed of three color toner images consisting of yellow (Y) toner, magenta (M) toner, and cyan (C) toner in each of the first to third regions Zc, Zl, and Zr so as to provide image densities ranging from 12% to 200% in total. Thus, the experiment was conducted after the image forming apparatus was installed in an environment of 23° C. in ambient temperature and 50% in relative humidity.

The experiment was started from a condition of 23° C. in detection temperature of the temperature detecting element 26 of the heater 23 of the fixing device F1. An experimental condition, such that the experiment is started from a state in which the fixing device F1 is cooled to the extent such that the detection temperature is the same as the ambient temperature in the environment in which the image forming apparatus is installed, is hereafter referred to as a cold start condition. Then, a fixing operation was performed in the cold start condition while changing the target temperature of the heater 23, and at each of the image densities, the target temperature at which the loss of the toner image on the recording material did not generate was checked (confirmed).

Figure 7:
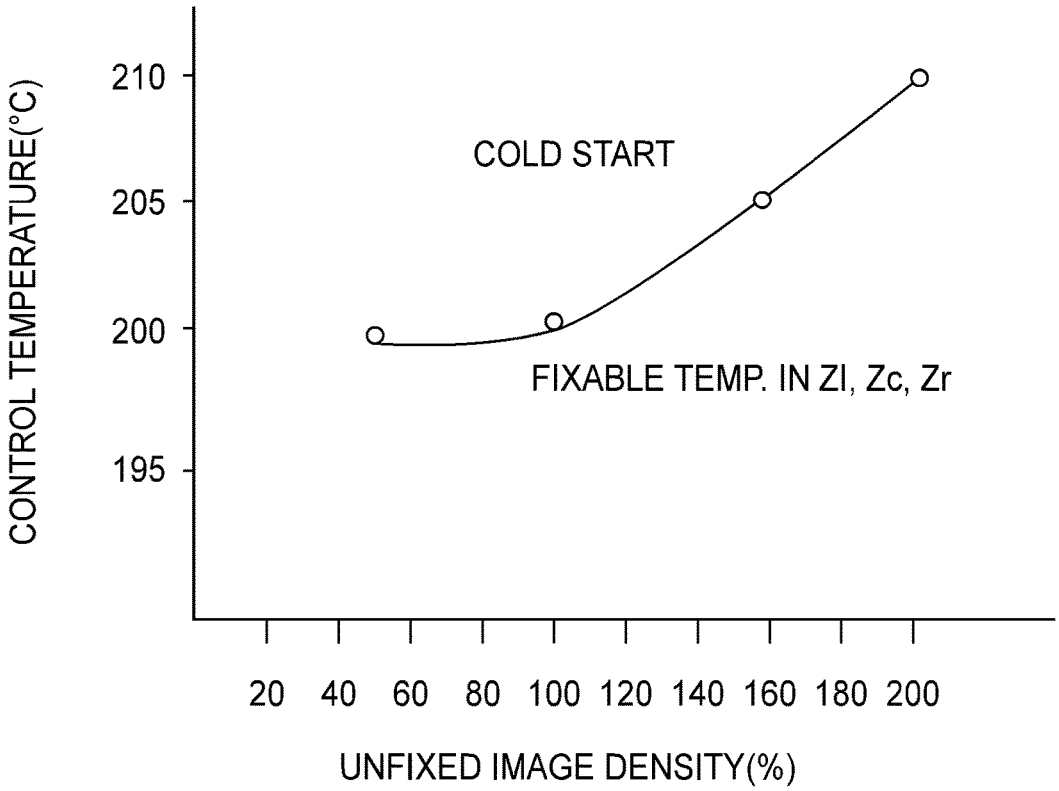
FIG. 7 is a graph showing a relationship between an image density and an optimum control (target) temperature of a fixing device in an experiment 1.

FIG. 7 is a graph showing a relationship between the image density and a fixable toner image. In FIG. 7, the abscissa represents the image density of the unfixed image t, and the ordinate represents the fixable toner image. When the image density increased, the target temperature necessary for fixing became high. The necessary target temperatures were the same in the first region Zc, the second region Zl, and the third region Zr.

When the image density was 100% or less, the toner image was able to be fixed without loss of the image at the target temperature of 200° C., referred to as a cold start condition. Then, a fixing operation was performed in the cold start condition while changing the target temperature of the heater 23, and at each of the image densities, the target temperature at which the loss of the toner image on the recording material did not generate was checked (confirmed).

Further, when the image density was 150% or less, the toner image was able to be fixed without loss of the image at the target temperature T of 205° C. Further, when the image density was 200%, the toner image was able to be fixed without loss of the image at the target temperature T of 210° C. Thus, depending on the image density, a minimum necessary fixing temperature is changed, so that a fixing property can be ensured while realizing electrical power saving.

(Charge in Fixing Property with Respect to Longitudinal Direction of Fixing Device F1)

Next, the heat-fixing operation was repeated, and, from a state in which the fixing device F1 was warmed up, the following experiment 2 was conducted.

(Experiment 2)

The heat-fixing operation was repeated 10 times or more every 20 seconds, and thereafter, the fixing device F1 was on standby. Then, an experiment 2 was started after a condition such that a detection temperature of the temperature detecting element 26 of the heater 23 of the fixing device F1 was 120° C. was met. Such an experimental condition that the experiment was started from a warming-up state of the fixing device F1 is hereafter referred to as a hot start condition. Other experimental conditions are similar to those of the experiment 1. Then, a fixing operation was performed in the hot start condition while changing the target temperature of the heater 23, and, at each of the image densities, the target temperature at which the loss of the toner image on the recording material did not generate was checked (confirmed).

Figure 8:
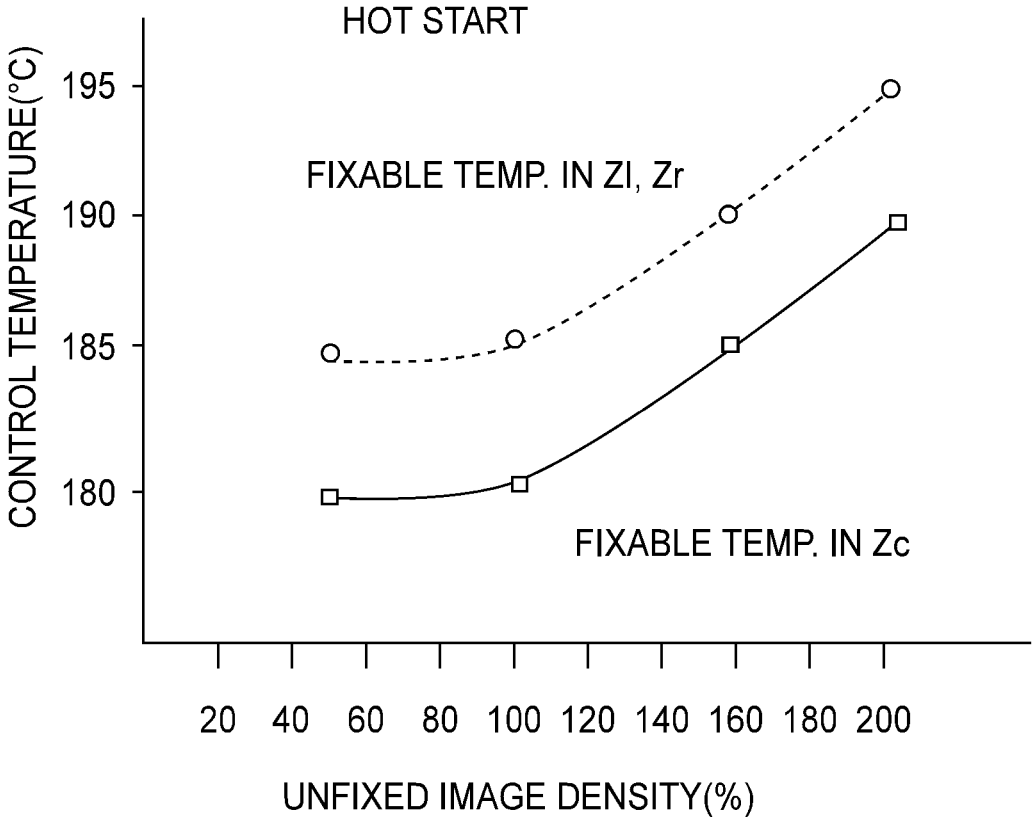
FIG. 8 is a graph showing a relationship between an image density and an optimum control temperature of a fixing device in an experiment 2.

FIG. 8 is a graph showing a relationship between the image density and a fixable toner image. In FIG. 8, the abscissa represents the image density of the unfixed image t, and the ordinate represents the fixable toner image. Similarly, as in the experiment 1, when the image density increased, the target temperature necessary for fixing became high. However, different from the experiment 1, a difference in necessary target temperature was found among the first region Zc, the second region Zl and the third region Zr.

Specifically, when the image density was 100% or less, the toner image in the first region Zc was able to be fixed without loss of the image at the target temperature of 180° C., but the toner images in the second region Zl and the third region Zr generated the loss of the image at the target temperature T of 180° C. The toner images in the second region Zl and the third region Zr were not able to be fixed unless the target temperature T was 185° C.

Further, when the image density was 150%, the toner image in the first region Zc was able to be fixed without loss of the image at the target temperature T of 185° C., but the toner images in the second region Zl and the third region Zr were not able to be fixed unless the target temperature T was 190° C. Further, when the image density was 200%, the toner image in the first region Zc was able to be fixed without loss of the image at the target temperature T of 190° C., but the toner images in the second region Zl and the third region Zr were not able to be fixed unless the target temperature T was 195° C.

As a reason why with respect to the longitudinal direction, the second region Zl and the third region Zr require a higher target temperature than the first region Zc, the following reason would be considered. That is, the heater holder 24 holding the heater 23 and the pressing roller 21 are supported by the fixing device side plates 71, but heat dissipates from the respective members toward the side plates 71, and therefore, longitudinal end portion temperatures of the respective members are liable to lower compared with the temperatures at the longitudinal central portions of the respective members.

Figure 9:
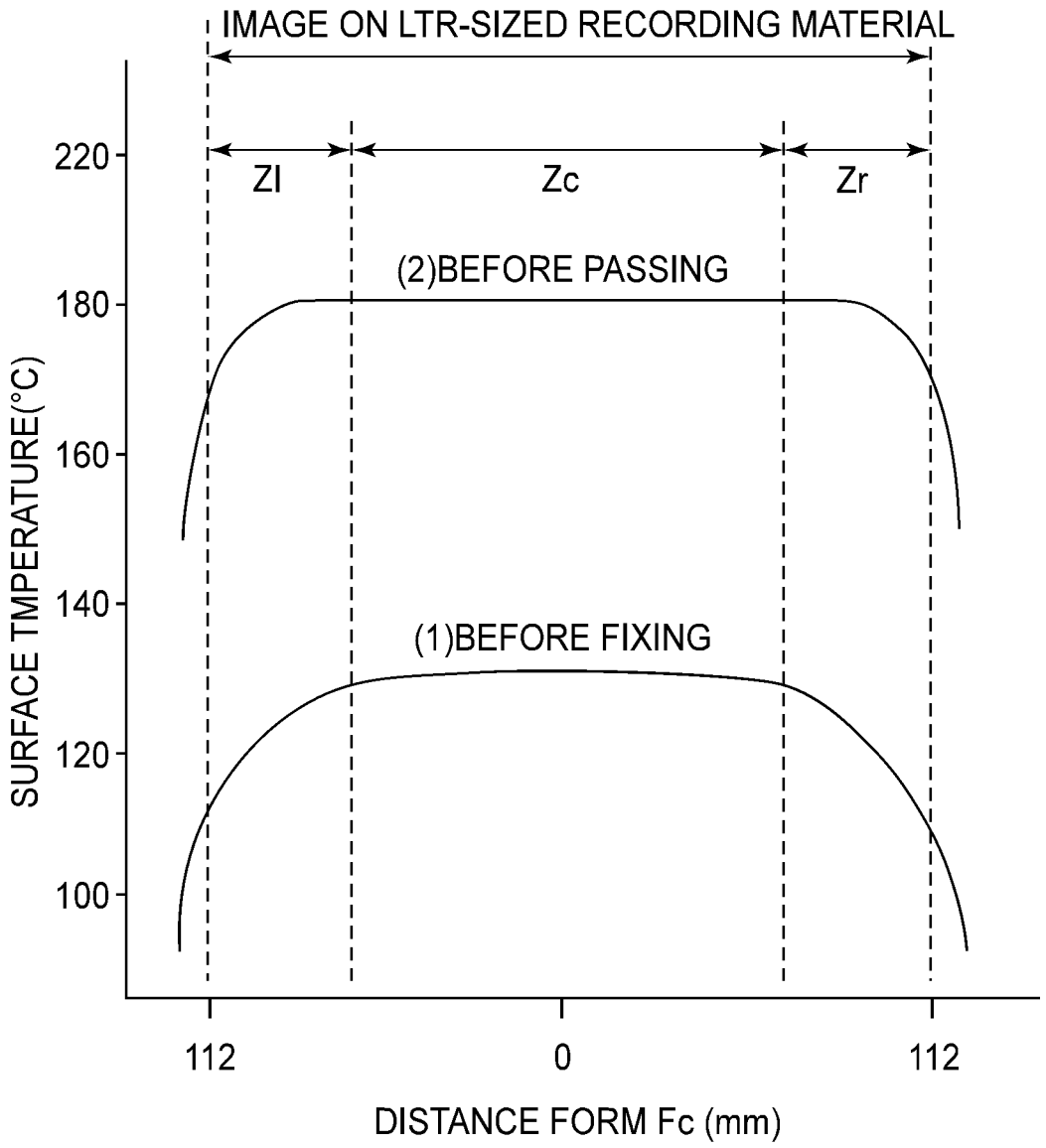
FIG. 9 is a graph showing a relationship between a longitudinal position of a fixing film and a temperature distribution of the fixing film in the experiment 2.

FIG. 9 shows surface temperature distributions of the fixing film 22 when the target temperature of the heater 23 is 200° C., in which (1) is the surface temperature distribution immediately before the fixing operation is started under the hot start condition, and (2) is the surface temperature distribution immediately before the fixing operation of the toner image on the recording material S is performed, when the temperature of the heater 23 is raised to the target temperature. In FIG. 9, the abscissa represents the surface temperature of the fixing film 22, and the ordinate represents a longitudinal position of the fixing film 22.

In the case of (1), the surface temperature of the fixing film 22 immediately before the fixing operation is started under the hot start condition is 130° C. at the central portion but is 110° C. at a position corresponding to each of image region end portions of the recording material S. On the other hand, in the case of (2), the surface temperature of the fixing film 22 immediately before the fixing operation of the toner image on the recording material S is performed when the temperature of the heater 23 is raised to the target temperature is 180° C. at the central portion but is 170° C. at a position corresponding to each of image region end portions of the recording material S. This is because the heat of the fixing film 22 warmed by the heat-fixing operation and the heat of the heater 23 and the heater holder 24 provided in the fixing film 22 dissipate into the fixing device side plates 71 through the heater holder 24.

Thus, the temperature lowers from end portions of the respective members, and therefore, a temperature difference generates with respect to the longitudinal direction. The heat-fixing operation was performed from a state in which the temperature difference was large, and therefore, even when the heater 23 was heated, and thus, the temperature reached the target temperature (target control temperature) at a position of the temperature detecting element 26 disposed at the central portion, the temperature of the fixing film 22 at each of the end portions was low.

As described above, a fixing performance of the fixing device F1 with respect to the longitudinal direction is not always uniform, and uniformity thereof changes depending on the warming-up state (degree of warming) of the fixing device F1. That is, the fixing performance of the fixing device F1 with respect to the longitudinal direction is substantially uniform in the cold start condition, but is nonuniform in the hot start condition. Here, the warming-up state means a degree of warming of the fixing device F1, so that a longitudinal temperature state (temperature distribution) can be assumed depending on the warming-up state.

(Target (Control) Temperature Setting Flow in this Embodiment)

In the image forming apparatus and the fixing device F1 in this embodiment, the image region is divided into a plurality of regions with respect to the longitudinal direction and image density information is acquired for each of the divided regions. Then, depending on the image density in a predetermined region, the target temperature of the fixing device F1 is changed. Further, depending on the warming-up state of the fixing device F1, the image region used for discriminating the change in target temperature is changed.

Figure 10:
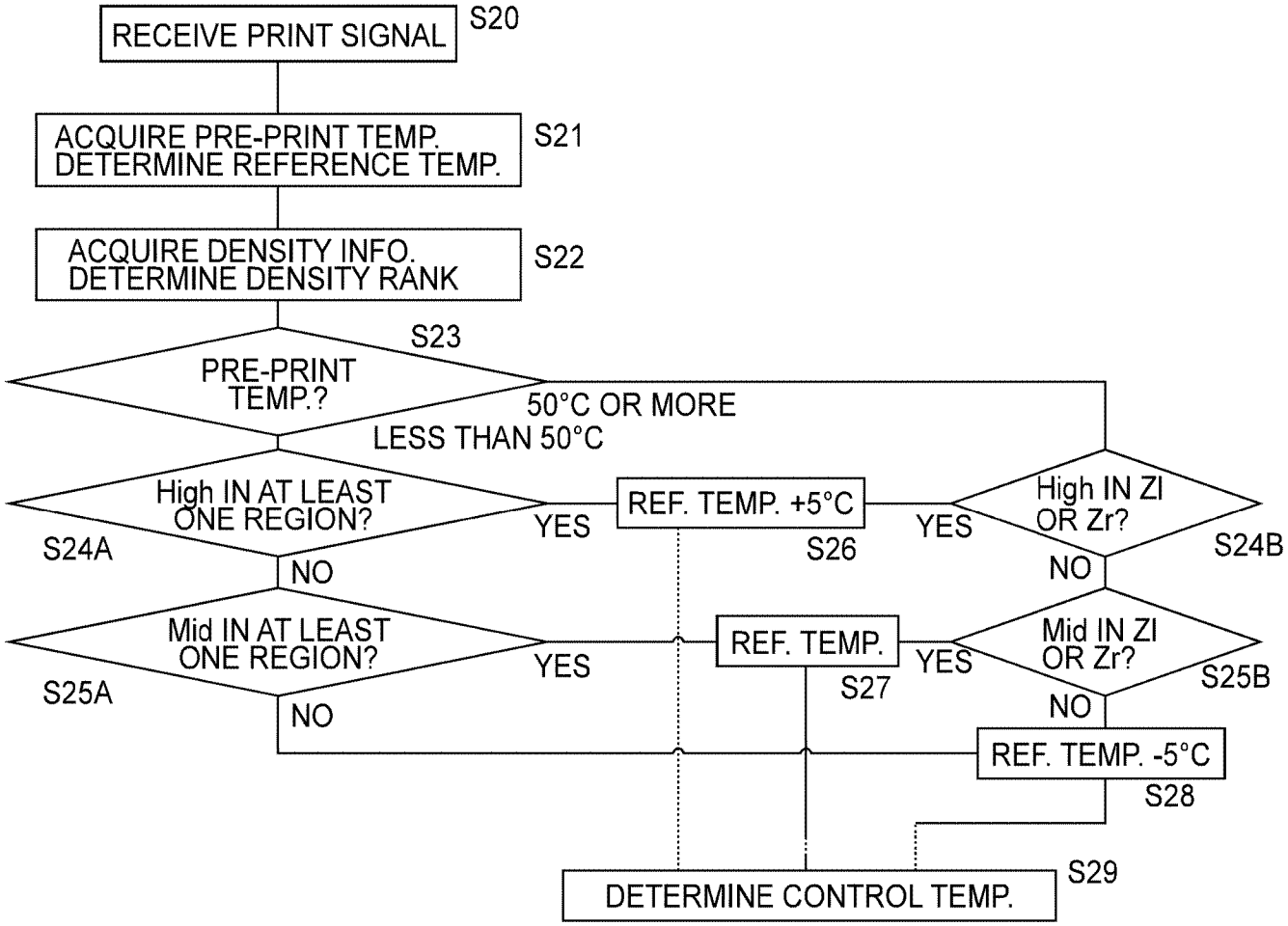
FIG. 10 is a flowchart illustrating a control temperature determining flow in the First Embodiment.

In the following, a target temperature determining flow of the fixing device F1 will be described along a flowchart of FIG. 10. When the image forming apparatus receives a print preparation signal from the host computer, the CPU acquires pre-print temperature (temperature before fixing) information, indicating the warming-up state of the fixing device F1, from the temperature detecting element 26 of the fixing device F1 (S20). Next, the image forming apparatus receives commands, such as a paper size and an operation mode, from the host computer and determines a reference target temperature as a reference heating amount from the paper size, the operation mode, the pre-print temperature information, a preceding print hysteresis, or the like (S21). This reference target temperature is an optimum target temperature for fixing an image having a standard image density, and is used as a base temperature, so that the target temperature is changed on the basis of the image density information.

Then, when the video controller 30 receives the image information from the host computer, the video controller 30 acquires density information in each of the divided image information acquiring regions Zc, Zl and Zr (S22). The density information is ranked by a threshold in each region, so that the density information is discriminated as a density (High) when the image density is not less than 150% higher than a reference range, and is discriminated as a density (Low) when the image density is less than 100% lower than the reference range. Further, the density information is discriminated as a density (Mid) when the image density falls within the reference range (less than 150% and not less than 100%). Here, the reference range (less than 150% and not less than 100%) is common to the image densities irrespective of not only the divided longitudinal region and the warming-up state of the fixing device F1.

On the basis of the pre-print temperature, whether the condition is the cold start condition in which the fixing property of the fixing device F1 with respect to the longitudinal direction is uniform or the hot start condition in which the fixing property of the fixing device F1 with respect to the longitudinal direction is nonuniform (S23). When the pre-print temperature is less than 50° C., the condition is discriminated as the cold start condition. In the case of the cold start condition, the target temperature of the fixing device F1 is determined on the basis of the image densities in all of the image information acquiring regions (S24A, S25A). In at least one of the image information acquiring regions, when the image density is the density (High), the target temperature of the fixing device F1 is set at a temperature higher than the reference target temperature by 5° C.

Further, when the image density is not the density (High) in either of the image information acquiring regions and is the density (Mid) in at least one of the image information acquiring regions, the target temperature of the fixing device F1 is set at the reference target temperature. Further, when the image density is not the density (High) and is not the density (Mid) in either of the image information acquiring regions, the target temperature of the fixing device F1 is set at a temperature lower than the reference target temperature by 5° C.

When the pre-print temperature is 50° C. or more, the condition is discriminated as the hot start condition. In the case of the hot start condition, the target temperature of the fixing device F1 is determined on the basis of the image densities only in the second region Zl and the third region Zr (S24B, S25B). In at least one of the second region Al and the third region Zr, when the image density is the density (High), the target temperature of the fixing device F1 is set at a temperature higher than the reference target temperature by 5° C.

Further, when the image density is not the density (High) in either of the second region Zl and the third region Zr and is the density (Mid) in at least one of the second region Zl and the third region Zr, the target temperature of the fixing device F1 is set at the reference target temperature. Further, when the image density is not the density (High) and is not the density (Mid) in either of the second region Zl and the third region Zr, the target temperature of the fixing device F1 is set at a temperature lower than the reference target temperature by 5° C.

The temperature of the heater 23 of the fixing device F1 is raised up to the above-set target temperature, and then the heat-fixing operation of the toner image on the recording material S is performed.

As described in the experiment 2, in the hot start condition, compared with the longitudinal end portions of the fixing device F1, the fixing property at the central portion is good. Even when the toner image with the image density of 200% is formed on the central portion of the recording material S, the toner image can be fixed at the target temperature lower than the reference target temperature by 5° C. Therefore, in the hot start condition, when the temperature falls within a changeable range of the target temperature in this embodiment, the target temperature can be determined using only the image density information at the end portions of the recording material S.

As a result, in the hot start condition, for example, even when the toner image with the image density of 200% is formed on the central portion of the recording material S, the target temperature can be lowered by 5° C. when the image density at the end portions is 100% or less.

Thus, in the image forming apparatus in this embodiment, in the cold start condition in which the fixing property of the fixing device F1 is uniform with respect to the longitudinal direction, the target temperature is determined using the image density information over an entire region of the recording material S with respect to the longitudinal direction. On the other hand, in the hot start condition, in which the fixing property is nonuniform between the central portion and each of the end portions, the target temperature is determined using the image density information only at the end portions of the recording material S. In other words, the temperature state of the fixing device 1 is discriminated and the fixing temperature distribution of the fixing device F1 with respect to the longitudinal direction is assumed, and then, the image region used for setting the heating amount, in which the recording material S is heated by the fixing device F1, is selected. That is, after the print signal is received, the CPU 306 sets the target temperature depending on the density information in the end regions irrespective of the density information in the central region in a case when the detection temperature of the temperature detecting element 26 is higher than the predetermined temperature, and sets the target temperature depending on the density information in the central region and in the end regions in a case when the detection temperature of the temperature detecting element 26 is lower than the predetermined temperature.

As a result, the necessary minimum fixing temperature is changed depending on the fixing performance of the fixing device F1 with respect to the longitudinal direction and the image density information, so that the fixing property can be ensured while realizing electric power saving.

Second Embodiment

In this embodiment, in an image forming apparatus in which a target temperature of a fixing device F1 is changed when an image density in a predetermined region exceeds a predetermined threshold, an image formable region is divided into a plurality of regions and then, a density threshold is set in each of the divided regions. Then, depending on a warming-up state of the fixing device F1, the threshold in each of image information acquiring regions is changed. A basic constitution of the image forming apparatus in this embodiment is the same as that in First Embodiment, and, therefore, elements having identical or corresponding functions and constitutions to those in First Embodiment are represented by the same reference numerals or symbols and will be omitted from detailed description.

In the following, a target temperature determining flow of the fixing device F1 will be described along a flowchart of FIG. 12. A basic flow (S30, S31) until a reference target temperature is determined is the same as that in the First Embodiment. In the image forming apparatus in this embodiment, on the basis of a pre-print temperature of the fixing device F1, in accordance with a table of FIG. 13, a reference density rank can be a threshold (reference threshold) in each of the image information acquiring regions (S32).

As shown in FIG. 13, a reference density rank is set for each of the first region Zc, the second region Zl, and the third region Zr, depending on a pre-print temperature indicating a warming-up state. That is, the reference density rank as the reference threshold is changeable depending on not only the divided regions with respect to the longitudinal direction, but also, the warming-up state of the fixing portion.

The reference density rank in each of the image information acquiring regions includes three levels (stages) of High, Mid, and Low. The reference density rank is obtained by acquiring an amount per unit area of the toner fixable at the reference target temperature in each of the divided longitudinal regions of the fixing device F1 through an experiment and then, by ranking the image density corresponding to the toner amount. For example, in the case of the warming-up state of the fixing device F1 such that the toner image can be fixed at the reference target temperature without image defect in the case when the image with the image density (Mid) is formed on the recording material S in the second region Zl, but the image defect generates due to an insufficient target temperature when the image with the image density (High) is formed on the recording material S in the second region Zl, the following ranking is made. That is, the reference density rank in the second region Zl in this case is determined as "Mid".

In the case when the pre-print temperature indicating the warming-up state exceeds 150° C. higher than the reference temperature, the reference density ranks in the second region Zl and the third region Zr are determined as "Low", so that weighing thereof is changed from that in the first region Zc (FIG. 13). As a result, even when the temperatures in the second region Zl and the third region Zr are low temperatures, the temperatures can be increased by temperature control.

Figure 12:
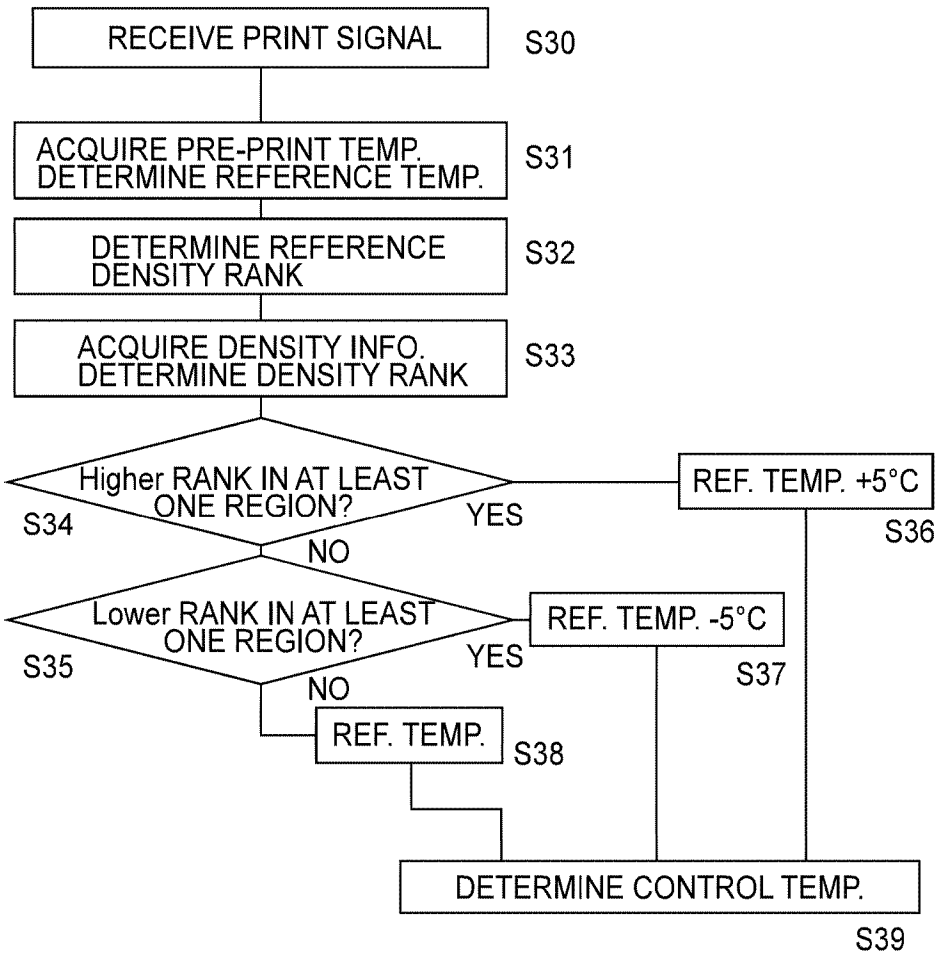
FIG. 12 is a flowchart illustrating a control temperature determining flow in the Second Embodiment.

In FIG. 12, similarly as in the First Embodiment, for each of the image information acquiring regions, the image information is acquired and the density rank is determined (S33). In this embodiment, for each of the image information acquiring regions, the density rank, which is acquired from the image information and, which is then ranked, is compared with the reference density rank set on the basis of the pre-print temperature of the fixing device F1 (S34, F35).

When the image density is higher in rank than the reference density, even in one of the first region Zc, the second region Zl and the third region Zr, the target temperature of the fixing device F1 is set at (reference target temperature)+5° C. For example, this is the case when the image density is "High" and the reference density is "Mid" in the first region Zc, or the case when the image density is "Mid", and the reference is "Low" in the first region Zc. Further, when the image density is lower in rank than the reference density in all of the first region Zc, the second region Zl and the third region Zr, the target temperature of the fixing device F1 is set at (reference target temperature)−5° C.

Thus, in this embodiment, from the warming-up state of the fixing device F1, the fixable image density is estimated in each of the divided longitudinal regions of the fixing device F1, and then, is compared with the reference density in each of the image regions. In the case when the image density exceeds the fixable image density (reference density), the target temperature is increased, and in the case when the image density is lower than the fixable image density (reference density), the target temperature is decreased. The temperature of the heater 23 of the fixing device F1 is raised to the set target temperature, and then, the heat-fixing operation of the recording material S is effected.

As a result, in this embodiment, the target temperature setting can be finely made correspondingly to the change in fixing non-uniformity of the fixing device with respect to the longitudinal direction and the image density distribution, so that electrical power saving can be realized while ensuring the fixing property.

Third Embodiment

In an image forming apparatus and a fixing device F1 in this embodiment, an image region is divided into a plurality of regions and image density information is acquired for each of the divided regions, and then, a target temperature of the fixing device F1 is changed depending on in a predetermined region. Further, depending on a sheet passing (feeding) hysteresis of the fixing device F1, the image region used for discriminating the change in target temperature is changed. A basic constitution of the image forming apparatus in this embodiment is the same as that in the First Embodiment, and therefore, elements having identical or corresponding functions and constitutions to those in the First Embodiment are represented by the same reference numerals or symbols, and will be omitted from a detailed description.

In the case when the heat-fixing operation is performed using a relatively small-sized recording material S (small-sized paper) with respect to the longitudinal direction of the fixing device F1, a difference in heat dissipation amount generates between a portion where the recording materials S contacts the portion and the heat is taken by the recording material S, and a portion where the recording material S does not contact the portion and the heat is not taken by the recording material S. That is, a phenomenon, conventionally called a non-sheet-passing portion temperature rise, such that the temperature of the fixing member in a region (non-sheet-passing region), in which the recording material S does not pass through the fixing nip Nf, is higher than the temperature of the fixing member in a region (sheet passing region), in which the recording material S passes through the fixing nip Nf generates.

In this embodiment, the following experiment 3 was conducted using an image forming apparatus that is the same as the image forming apparatus in First Embodiment, a longitudinal temperature distribution of the fixing device F1 due to the non-sheet-passing portion temperature rise after the sheet passing of the small-sized paper was checked.

(Experiment 3)

The process speed of the image forming apparatus used in the experiment is 100 mm/s, and an interval (sheet interval) between a recording material S and a subsequent recording material S is 100 mm. The fixing device F1 is the heat-fixing device used in First embodiment. In the experiment, a general-purpose LBP printing paper, i.e., an A5-sized paper (width=148 mm, length=210 mm, basis weight=80 g/m$^2$) was used. Further, the experiment was conducted after the image forming apparatus was installed in an environment of 23° C. in ambient temperature and 50% in relative humidity.

A sufficient period elapsed from the preceding heat-fixing operation of the fixing device F1, and then, the experiment was started from a condition in which the detection temperature of the temperature detecting element 26 of the heater 23 of the fixing device F1 was in a range of 23° C.±5° C. The target temperature of the heater 23 was 200° C., and the fixing operation of toner images was continuously performed on 10 sheets.

Figure 14:
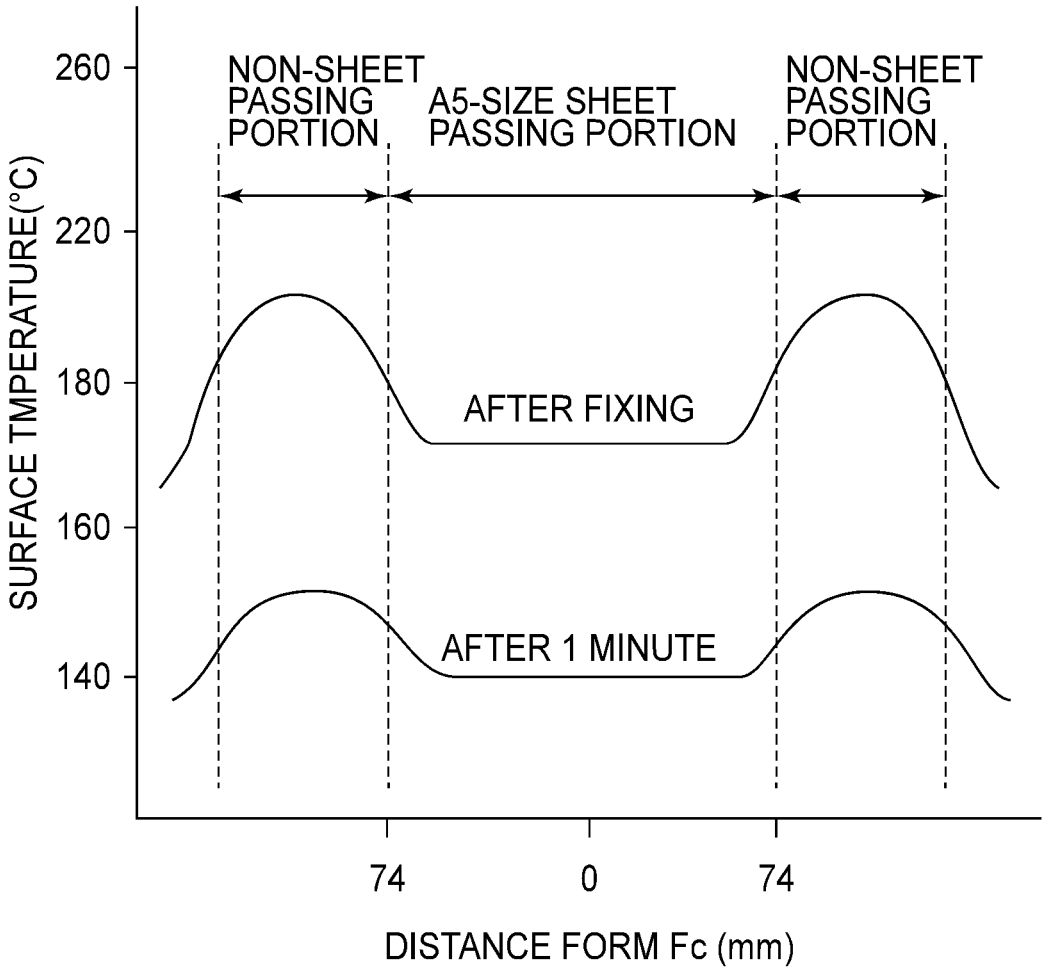
FIG. 14 is a graph showing a relationship between a longitudinal position of a fixing film and a temperature distribution of the fixing film in an experiment 3.

FIG. 14 shows a surface temperature distribution of the fixing film 22 immediately after an end of the fixing operation and a surface temperature distribution of the fixing film 22 after a lapse of 1 minute. In FIG. 14, the ordinate represents the surface temperature of the fixing film 22, and the abscissa is a longitudinal position of the fixing film 22. From the surface temperature distribution of the fixing film 22 immediately after the end of the fixing operation of the toner image on the A5-sized recording material S, it is understood that the temperature at the non-sheet-passing portion of the A5-sized recording material P is higher than the temperature at the sheet passing portion of the A5-sized recording material S. Further, also as regards the surface temperature distribution after the lapse of 1 minute, the temperature at the non-sheet-passing portion is still higher than the temperature at the sheet passing portion.

In the case when printing on paper larger in width with respect to the longitudinal direction of the fixing device F1 than the A5-sized recording material S is carried out, with respect to the longitudinal direction of the fixing device F1, between a region that was the sheet passing portion of the A5-sized recording material S and a region which was the non-sheet-passing portion of the A5-sized recording material S, a difference in fixing performance generates. Therefore, in the image forming apparatus and the fixing device F1 in this embodiment, an image region used for discriminating a change in target temperature depending on sheet passing hysteresis of the fixing device F1 is determined to be the first recording material Zc. As a result, even in the case where the difference in fixing performance with respect to the longitudinal direction of the fixing device F1 generates due to the sheet passing hysteresis, a proper fixing temperature setting depending on the image density can be made.

Figure 15:
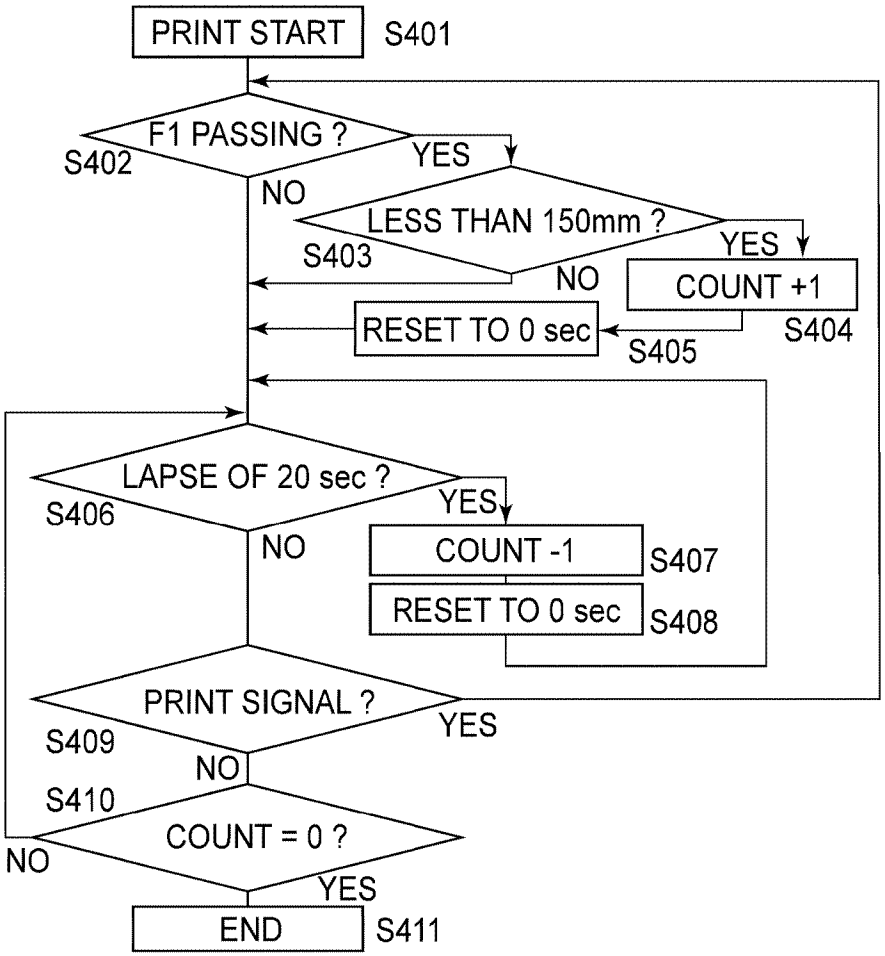
FIG. 15 is a flowchart illustrating a small-size (recording material) integration count determining flow in a Third Embodiment.

An acquiring method of the sheet passing hysteresis will be described along a flowchart of FIG. 15. When printing is started (S401), the case when the recording material S having a width, with respect to the longitudinal direction of the fixing device F1, less than a predetermined-sized recording material is passed through the fixing device F1 is detected, and the number of sheets passed through the fixing device F1 is counted and is stored as a small-sized recording material integration count in a memory of the CPU 306 (FIG. 4). This small-sized recording material integration count is used for estimating a level of the non-sheet-passing portion temperature rise in the non-sheet-passing region of the small-sized recording material in the fixing device F1.

In this embodiment, one sheet is counted up to the small-sized recording material integration count every passing of one sheet of the recording material S narrower in width than 150 mm, which is the width of the first region Zc (S402 to S404). Every time after a lapse of 20 seconds from the passing of the small-sized recording material S through the fixing device F1, one sheet is counted down from the small-sized recording material integration count (S405 to S408). This operation is performed in consideration of alleviation of a level of the non-sheet-passing portion temperature rise by heat dissipation, or the like. Even after the print signal is not sent to the image forming apparatus and the printing is ended, processes (S406 to S410) are repeated until the small-sized recording material integration count becomes zero.

In the case when a subsequent print signal is received before the small-sized recording material integration count becomes zero, in the image forming apparatus in this embodiment, on the basis of the small-sized recording material integration count at this time, a position of the image information acquiring region used for discriminating the change in target temperature of the fixing device F1 is changed.

Figure 16:
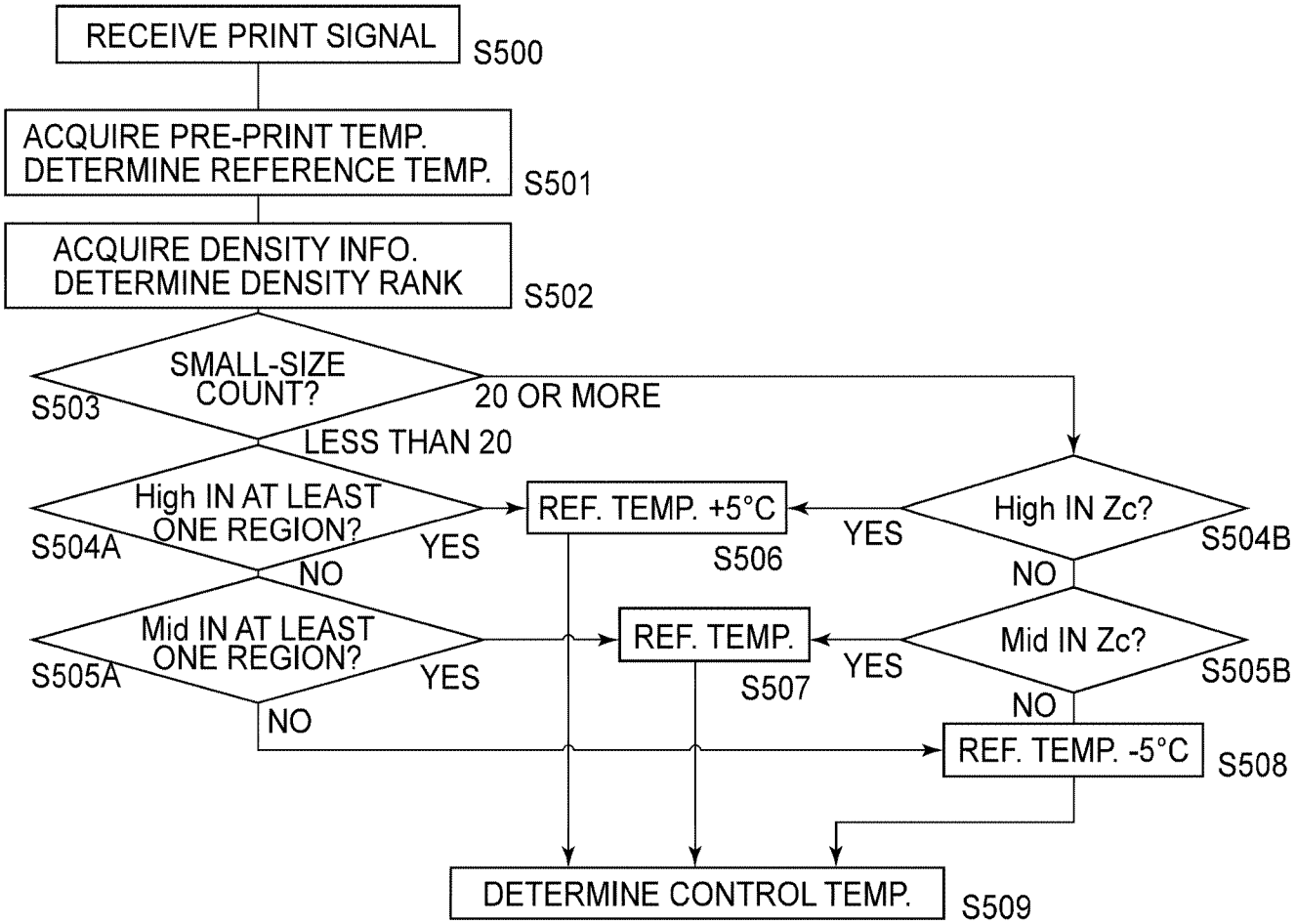
FIG. 16 is a flowchart illustrating a control temperature determining flow in the Third Embodiment.

In the following, a target temperature determining flow in this embodiment will be described along a flowchart of FIG. 16. The flow from the receipt of the print signal, until the image density rank is determined, is the same as the flow in the First Embodiment (S501, S502). In the image forming apparatus in this embodiment, when the small-sized recording material integration count is 20 or more, a discrimination that an influence of the non-sheet-passing portion temperature rise in the preceding printing largely remains, and the fixing property at the longitudinal end portions of the fixing device F1 is advantageous is, made (S503). As a result, a change is made so that the target temperature of the fixing device F1 is set on the basis of the image density only in the first region Zc, which is the central portion of the fixing device F1 with respect to the longitudinal direction.

That is, when the image density is the density (High) in the first region Zc, the target temperature of the fixing device F1 is set at a temperature higher than the reference target temperature by 5° C. (S504B, S506). Further, when the image density is the density (Mid) in the first region Zc, the target temperature of the fixing device F1 is set at the reference target temperature (S505B, S507). Further, when the image density is not the density (High) and is not the density (Mid) in the first region Zc, the target temperature of the fixing device F1 is set at a temperature lower than the reference target temperature by 5° C. (S508).

On the other hand, when the small-sized recording material integration count is 20 or less, a discrimination that the influence of the non-sheet-passing portion temperature rise on the fixing device F1 by the preceding printing is small is made (S503). That is, the target temperature of the fixing device F1 is determined on the basis of the image densities in all of the image information acquiring regions. In at least one of the image information acquiring regions, when the image density is the density (High), the target temperature of the fixing device F1 is set at a temperature higher than the reference target temperature by 5° C. (S504A, S506).

Further, when the image density is not the density (High) in either of the image information acquiring regions and is the density (Mid) in at least one of the image information acquiring regions, the target temperature of the fixing device F1 is set at the reference target temperature (S505A, S507). Further, when the image density is not the density (High) and is not the density (Mid) in either of the image information acquiring regions, the target temperature of the fixing device F1 is set at a temperature lower than the reference target temperature by 5° C. (S508).

In this embodiment, the target temperature setting can be finely made correspondingly to the change in fixing performance of the fixing device F1 with respect to the longitudinal direction due to the passing of the small-sized recording material and correspondingly to the image density distribution, so that electrical power saving can be realized while ensuring the fixing property.

Fourth Embodiment

An image forming apparatus in this embodiment includes a cooling fan as at least one of air blowing means for cooling an inside of an image forming apparatus main assembly. Further, depending on an operation hysteresis (presence or absence of a driving state) of this cooling fan, a position of an image information acquiring region used for discrimination of a change in target temperature of the fixing device F1 is changed. A basic constitution of the image forming apparatus in this embodiment is the same as that in the First Embodiment, and therefore, elements having identical or corresponding functions and constitutions to those in the First Embodiment are represented by the same reference numerals or symbols and will be omitted from a detailed description.

Figure 17:
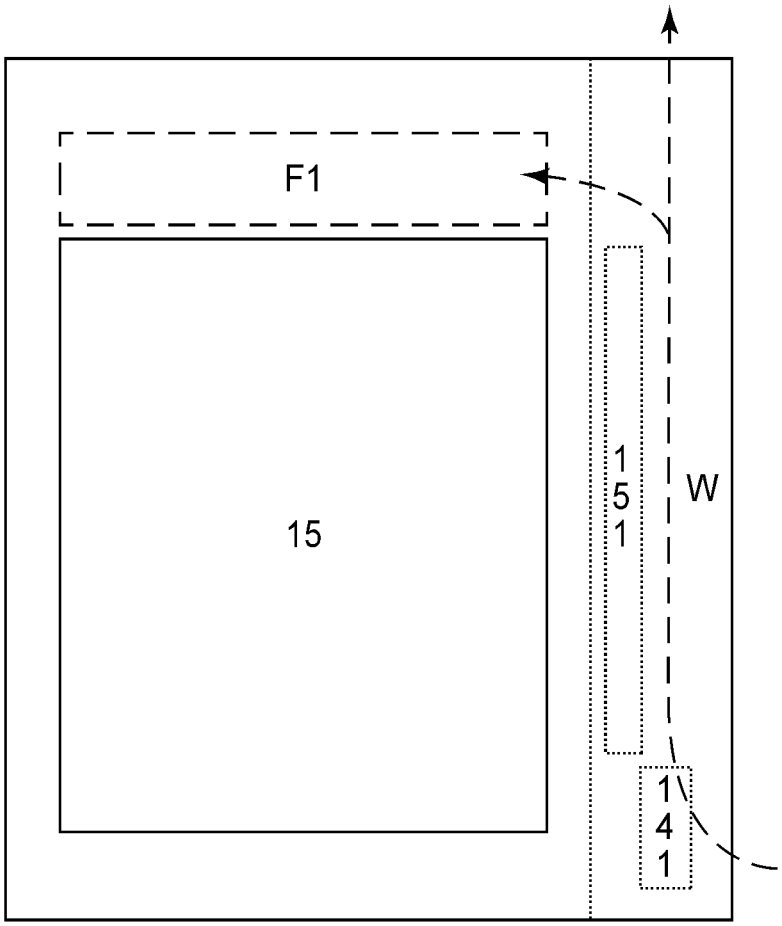
FIG. 17 is a schematic view illustrating an arrangement of a cooling fan and an air course in an image forming apparatus in a Fourth Embodiment.

In the following, the cooling fan and an air course will be described with reference to FIG. 17. FIG. 17 is a schematic plan view showing an arrangement of the fixing device F1, a cooling fan 141, and an air course W in the image forming apparatus. At a side surface portion of the image forming apparatus, the cooling fan 141 as a cooling means for exhausting heat from a voltage (power) source portion 151 is provided, and the air course is formed along an arrow W direction. The cooling fan 141 is, for example, a DC fan motor of 80 mm×80 mm in dimension, 15 mm in depth, 0.58 ($m^3$/min) in maximum airflow rate, and 22.6 (Pa) in maximum static pressure. The air sucked from the cooling fan 141 passes along the voltage source portion 151 and flows into a side surface of the fixing device F1.

When the cooling fan 141 operates during the heating operation of the fixing device F1 or in the warming-up state of the fixing member of the fixing device F1, heat of the fixing member of the fixing device F1 is taken by the air flowing into the fixing device F1 through the side surface of the fixing device F1. As a result, a temperature non-uniformity generates between the central portion and each of the end portions of the fixing member of the fixing device F1.

In the image forming apparatus and the fixing device F1 in this embodiment, an image formable region is divided into a plurality of image information acquiring regions, and image density information is acquired for each of the divided regions. Then, depending on an image density in a predetermined region, the target temperature of the fixing device F1 is changed. Further, depending on the presence or absence of the operation hysteresis of the cooling fan 141, the position of the image information acquiring region used for discrimination of the change in target temperature of the fixing device F1 is changed.

Figure 18:
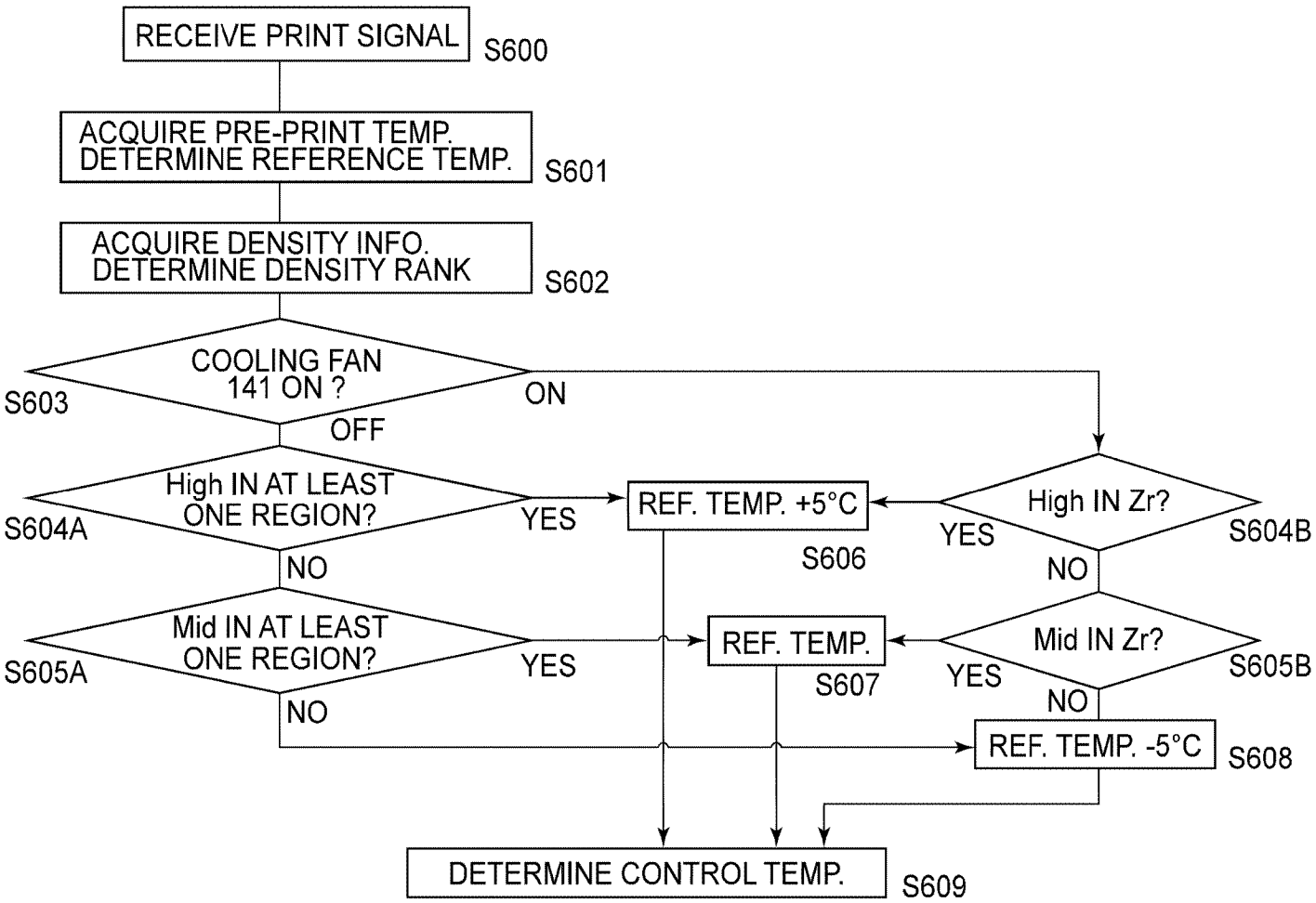
FIG. 18 is a flowchart illustrating a control temperature determining flow in the Fourth Embodiment.

In the following, a target temperature determining flow of the fixing device F1 in this embodiment will be described along a flowchart of FIG. 18. The flow from the receipt of the print signal, until the image density rank is determined, is the same as the flow in First Embodiment (S601, S602). Then, whether or not the cooling fan 141 operates is discriminated (S603). In the case when the cooling fan 141 operates, a discrimination that with respect to the longitudinal direction of the fixing device F1, the temperature in the third region Zr lowers, and thus, the fixing performance is disadvantageous, is made.

That is, the target temperature of the fixing device F1 is changed on the basis of the image density only in the third region Zr in a side closest to the cooling fan 141 of the fixing device F1 with respect to the longitudinal direction. Specifically, when the image density is the density (High) in the third region Zr, the target temperature of the fixing device F1 is set at a temperature higher than the reference target temperature by 5° C. (S604B, S606). Further, when the image density is the density (Mid) in the third region Zr, the target temperature of the fixing device F1 is set at the reference target temperature (S605B, S607). Further, when the image density is not the density (High) and is not the density (Mid) in the third region Zr, the target temperature of the fixing device F1 is set at a temperature lower than the reference target temperature by 5° C. (S608).

On the other hand, in the case when the cooling fan 141 does not operate, the target temperature of the fixing device F1 is determined on the basis of the image densities in all of the image information acquiring regions with respect to the longitudinal direction. In at least one of the image information acquiring regions, when the image density is the density (High), the target temperature of the fixing device F1 is set at a temperature higher than the reference target temperature by 5° C. (5604A, S606). Further, when the image density is not the density (High) in either of the image information acquiring regions and is the density (Mid) in at least one of the image information acquiring regions, the target temperature of the fixing device F1 is set at the reference target temperature (5605A, S607).

Further, when the image density is not the density (High) and is not the density (Mid) in either of the image information acquiring regions, the target temperature of the fixing device F1 is set at a temperature lower than the reference target temperature by 5° C. (S608).

Thus, in this embodiment, the target temperature setting can be finely made correspondingly to the change in fixing non-uniformity of the fixing device F1 by the CF with respect to the longitudinal direction and correspondingly to the image density distribution, so that electrical power saving can be realized while ensuring the fixing property.

MODIFIED EMBODIMENTS

In the above-described embodiments, the preferred embodiments of the present invention were described, but the present invention is not limited thereto, and can be variously modified within the scope of the present invention.

Modified Embodiment 1

In the above-described embodiments, on the basis of the pre-print temperature indicating the warming-up state, the temperature state of the fixing device F1 with respect to the longitudinal direction was acquired by assumption, but the longitudinal temperature state of the fixing device F1 can also be acquired by another method. For example, as the hysteresis of the preceding heat-fixing operation, from the number of the recording materials S subjected to the heat-fixing of the toner images, a thickness of such recording materials S, an elapsed time from the preceding heat-fixing operation, the target temperature of the fixing device F1, an integrated heating time of the fixing device F1, or the like, the warming-up state of the fixing device F1 can also be assumed (specified). That is, the longitudinal temperature state of the fixing device F1 can also be acquired by being assumed on the basis of the hysteresis of the heat-fixing operation.

Figure 11:
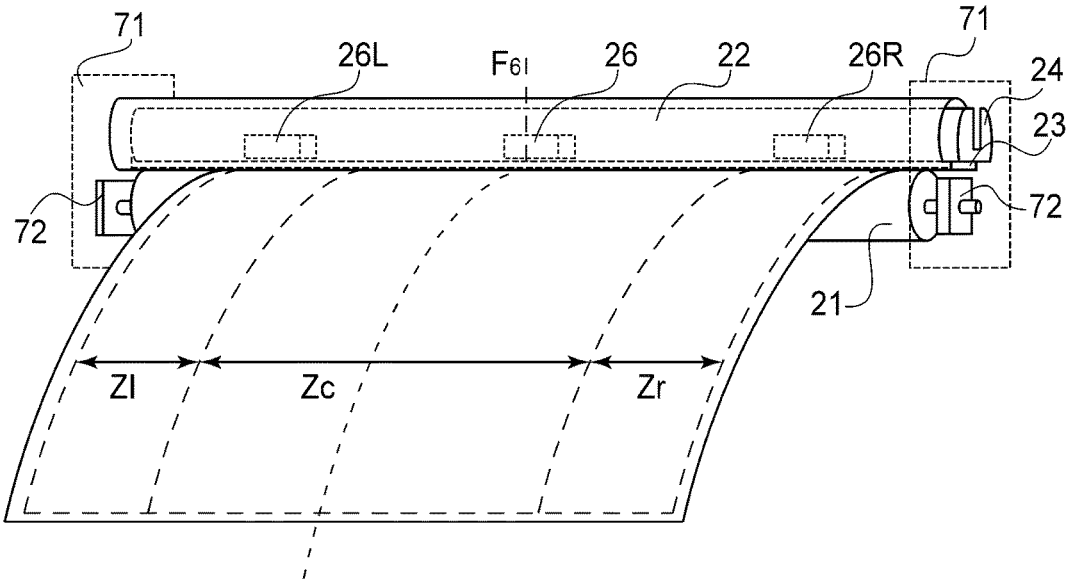
FIG. 11 is a schematic view illustrating an example of an arrangement of a plurality of temperature detecting elements in a longitudinal direction of the fixing device.

Further, as shown in FIG. 11, temperature detecting elements 26L and 26R are provided at longitudinal end portions of the fixing device F1, and the longitudinal temperature state of the fixing device F1 can also be acquired (specified) by measurement using the plurality of temperature detecting elements provided along the longitudinal direction of the fixing device F1.

Modified Embodiment 2

In the above-described embodiments, depending on the image density information, the target temperature of the fixing device F1 was changed as the heating amount control, but other means may also be employed when the heat quantity supplied to the toner image on the recording material S can be changed to a proper heat quantity. For example, in place of the change of the target temperature, the process speed (at which the toner image is fixed on the recording material S while nipping and feeding the recording material S) may also be changed as the heating amount control depending on the image density information.

In the above-described embodiments, the process speed of the image forming apparatus was 100 mm/s, and the interval (sheet interval) between a recording material S and a subsequent recording material S was 30 mm. Here, depending on the image density information, by decreasing the process speed from 100 mm/s to, e.g., 80 mm/s, a time of passing of the recording material S through the fixing nip Nf can be increased by 20%. In this case, even at the same target temperature, a time of heat conduction from the heater 23 to the toner image on the recording material S through the heating film 22 increases, and therefore, a more heat quantity can be supplied to the toner image.

An optimum heat quantity can be supplied to the toner image depending on the amount of the toner on the recording material S by decreasing the process speed when the image density is high and by increasing the process speed when the image density is low.

Further, in place of the target temperature, the sheet (paper) interval (recording material feeding interval) between the recording material S and the subsequent recording material S may also be changed as the heating amount control depending on the image density information. For example, by increasing the sheet interval from 30 mm to 50 mm, the fixing member such as the fixing film 22 or the pressing roller 21 can be warmed in the sheet interval, so that the fixing property of the toner image on the subsequent recording material S can be improved by the heat quantity accumulated in the fixing member during the sheet interval. Further, the optimum heat quantity can be supplied to the toner image depending on the amount of the toner on the recording material S by increasing the sheet interval when the image density is high and by decreasing the sheet interval when the image density is low.

Modified Embodiment 3

In the above-described embodiments, recording paper was used as the recording material, but the recording material in the present invention is not limited to recording paper. In general, the recording material is a sheet-like member on which the toner image is to be formed by the image forming apparatus, and includes, for example, regular or irregular plain paper, thick paper, thin paper, an envelope, a postcard, a seal, a resin sheet, an OHP sheet, glossy paper, and the like. In the above-described embodiments, for convenience, as regards treatment of the recording material P, a description was made using terms such as the sheet (paper) passing and the sheet (paper) interval, but, by this, the recording material in the present invention is not limited to this paper.

Modified Embodiment 4

In the above-described embodiments, the fixing device for fixing the unfixed toner image on the sheet was described as an example, but the present invention is not limited thereto. The present invention is similarly applicable to a device (apparatus) for heating and pressing a toner image temporarily fixed on the sheet in order to improve gloss (glossiness) of an image (also, in this case, the device is referred to as the fixing device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming portion configured to form a toner image on a recording material on the basis of image information;

a fixing portion configured to fix the toner image on the recording material, wherein said fixing portion includes a heating member and an opposing member configured to form a nip in cooperation with said heating member in contact with said heating member;

a temperature detecting member configured to detect a temperature of said heating member;

a controller configured to control electrical power supplied to said heating member so that the temperature detected by said temperature detecting member is a target temperature; and an acquiring portion configured to acquire density information of the toner image from the image information, wherein said acquiring portion acquires the density information in each of a central region and an end region of an image formable region of the recording material with respect to a widthwise direction perpendicular to a feeding direction of the recording material, wherein the recording material, on which the toner image is formed, is heated while being fed in the nip, and the toner image is fixed on the recording material, and wherein, when a detection temperature by said temperature detecting member is higher than a predetermined temperature at a timing immediately after an image formation start signal is received, said controller sets the target temperature depending on the density information in the end region irrespective of the density information in the central region, and wherein, when the detection temperature of said temperature detecting member is lower than the predetermined temperature, said controller sets the target temperature depending on the density information in the central region and the density information in the end region.

2. An image forming apparatus according to claim 1, wherein, when a density in the end region is higher than a predetermined density, said controller sets the target temperature so as to be higher than the target temperature when the density in the end region is lower than the predetermined density.

3. An image forming apparatus according to claim 1, wherein said heating member includes a cylindrical fixing film in contact with an outer surface of said opposing member and a heater in contact with an inner surface of said fixing film.

4. An image forming apparatus according to claim 3, wherein a length of said heater in the widthwise direction is greater than the image formable region of the recording material with respect to the widthwise direction of the recording material.

5. An image forming apparatus according to claim 3, wherein the nip is formed by said heater and said opposing member through said fixing film.

6. An image forming apparatus comprising:

an image forming portion configured to form a toner image on a recording material on the basis of image information;

a fixing portion configured to fix the toner image on the recording material, wherein said fixing portion includes a heating member and an opposing member configured to form a nip in cooperation with said heating member in contact with said heating member;

a controller configured to control electrical power supplied to said heating member so that the temperature of said heating member is maintained at a target temperature; and an acquiring portion configured to acquire density information of the toner image from the image information, wherein the recording material, on which the toner image is formed, is heated while being fed in the nip, and the toner image is fixed on the recording material, and wherein said controller selects a region of an image formable region of the recording material with respect to a widthwise direction perpendicular to a feeding direction of the recording material for setting the target temperature in a fixing operation in accordance with a pre-print temperature of said fixing portion, and sets the target temperature in the fixing operation in accordance with the density information of the selected region.

7. An image forming apparatus according to claim 6, wherein said acquiring portion acquires the density information in each of a central region and an end region of the image formable region with respect to the widthwise direction, wherein, when the pre-print temperature is higher than a predetermined temperature, said controller sets the target temperature depending on the density information in the end region irrespective of the density information in the central region, and wherein, when the pre-print temperature is lower than the predetermined temperature, said controller sets the target temperature depending on the density information in the central region and the density information in the end region.

8. An image forming apparatus according to claim 7, wherein, when a density in the end region is higher than a predetermined density, said controller sets the target temperature so as to be higher than the target temperature when the density in the end region is lower than the predetermined density.

9. An image forming apparatus according to claim 6, wherein said heating member includes a cylindrical fixing film in contact with an outer surface of said opposing member and a heater in contact with an inner surface of said fixing film.

10. An image forming apparatus according to claim 9, wherein a length of said heater in the widthwise direction is greater than the image formable region of the recording material with respect to the widthwise direction of the recording material.

11. An image forming apparatus according to claim 9, wherein the nip is formed by said heater and said opposing member through said fixing film.

12. An image forming apparatus comprising:

an image forming portion configured to form a toner image on a recording material on the basis of image information;

a fixing portion configured to fix the toner image on the recording material, wherein said fixing portion includes a heating member and an opposing member configured to form a nip in cooperation with said heating member in contact with said heating member;

a controller configured to control electrical power supplied to said heating member so that the temperature of said heating member is maintained at a target temperature; and an acquiring portion configured to acquire density information of the toner image from the image information, wherein the recording material, on which the toner image is formed, is heated while being fed in the nip, and the toner image is fixed on the recording material, and wherein said controller selects a region of an image formable region of the recording material with respect to a widthwise direction perpendicular to a feeding direction of the recording material for setting the target temperature in a fixing operation in accordance with a recording material passing hysteresis, and sets the target temperature in the fixing operation in accordance with the density information of the selected region.

13. An image forming apparatus according to claim 12, wherein the recording material passing hysteresis is an integration count acquired based on a number of recording materials narrower in width with respect to the widthwise direction than a predetermined-size having been passed through the nip, and a lapse time of recording materials narrower in width than the predetermined-size having been passed through the nip.

14. An image forming apparatus according to claim 13, wherein said acquiring portion acquires the density information in each of a central region and an end region of an image formable region of the recording material with respect to the widthwise direction perpendicular to the feeding direction of the recording material, wherein, when the integration count is higher than a predetermined count, said controller sets the target temperature depending on the density information in the central region irrespective of the density information in the end region, and wherein, when the integration count is lower than the predetermined count, said controller sets the target temperature depending on the density information in the central region and the density information in the end region.

15. An image forming apparatus according to claim 14, wherein, when a density in the central region is higher than a predetermined density, said controller sets the target temperature so as to be higher than the target temperature when the density in the central region is lower than the predetermined density.

16. An image forming apparatus according to claim 12, wherein said heating member includes a cylindrical fixing film being in contact with an outer surface of said opposing member and a heater being in contact with an inner surface of said fixing film.

17. An image forming apparatus according to claim 16, wherein a length of said heater in the widthwise direction is greater than the image formable region of the recording material with respect to the widthwise direction of the recording material.

18. An image forming apparatus according to claim 16, wherein the nip is formed by said heater and said opposing member through said fixing film.

* * * * *